US010981384B2

(12) United States Patent
Mizuno et al.

(10) Patent No.: US 10,981,384 B2
(45) Date of Patent: Apr. 20, 2021

(54) LIQUID DISCHARGE HEAD

(71) Applicant: Brother Kogyo Kabushiki Kaisha, Nagoya (JP)

(72) Inventors: Taisuke Mizuno, Yokkaichi (JP); Hideki Hayashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 5 days.

(21) Appl. No.: 16/722,628

(22) Filed: Dec. 20, 2019

(65) Prior Publication Data

US 2020/0238698 A1 Jul. 30, 2020

(30) Foreign Application Priority Data

Jan. 28, 2019 (JP) ..... JP2019-011947

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ..... B41J 2/1433; B41J 2002/14419; B41J 2002/14241; B41J 2202/12; B41J 2/14233
See application file for complete search history.

(56) References Cited

U.S. PATENT DOCUMENTS

2008/0238980 A1 10/2008 Nagashima et al.
2019/0299619 A1* 10/2019 Katayama ..... B41J 2/175

FOREIGN PATENT DOCUMENTS

JP 2008-254196 A 10/2008

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

There is provided a liquid discharging head including: first and second individual channel rows having first individual channels and second individual channels aligned in a first direction, respectively; first and second common channels having first and second connecting parts, respectively; and a connecting channel connecting the plurality of first individual channels and the plurality of second individual channels to one another. The connecting channel has: a common connecting channel which does not have a connecting part with respect to the liquid supply source and which is communicated with the plurality of first individual channels and the plurality of second individual channels; a plurality of first individual connecting channels and a plurality of second individual connecting channels which connect the plurality of first individual channels and the plurality of second individual channels, respectively, to the common connecting channel.

22 Claims, 14 Drawing Sheets

LIQUID DISCHARGE HEAD

CROSS REFERENCE TO RELATED APPLICATION

The present application claims priority from Japanese Patent Application No. 2019-011947 filed on Jan. 28, 2019, the disclosure of which is incorporated herein by reference in its entirety.

BACKGROUND

Field of the Invention

The present disclosure relates to a liquid discharge head which discharges a liquid from a nozzle.

Description of the Related Art

As an example of a liquid discharge head which discharges a liquid from a nozzle, there is a publicly known recording head which discharges an ink from nozzles. In this publicly known recording head, a first pressure chamber row and a second pressure chamber row, each of which is formed by a plurality of pressure chambers aligned in one direction, are arranged side by side in a direction orthogonal to the one direction. The plurality of pressure chambers forming the first pressure chamber row are connected to a first common channel, and the plurality of pressure chambers forming the second pressure chamber row are connected to a second common channel. Further, each of the pressure chambers is connected to a nozzle via a nozzle channel. Furthermore, a plurality of nozzle channels corresponding to the first pressure chamber row and a plurality of nozzle channels corresponding to the second pressure chamber row are connected individually to one another, respectively, via a plurality of return channels.

In the above-described recording head, the ink flows from the first common channel to the plurality of pressure chambers constructing the first pressure chamber row. Further, the ink flows out from the plurality of pressure chambers constructing the first pressure chamber row to the plurality of pressure chambers constructing the second pressure chamber row, via the nozzle channels and the return channels, respectively. Furthermore, the ink flows out from the plurality of pressure chambers constructing the second pressure chamber row to the second common channel. With this, the ink inside the recording head is circulated.

Here, in the above-described recording head, since the plurality of return channels are provided individually with respect to the plurality of pressure chambers, respectively, each of the return channels has a small cross-sectional area in a cross section orthogonal to the length direction thereof. Namely, each of the return channels has a large channel resistance. Accordingly, there is such a fear that the ink might not be flowed from the pressure chambers constructing the first pressure chamber row to the pressure chambers constructing the second pressure chamber row, respectively, sufficiently or at any sufficient amount. Further, in a case that the channel resistance in the return channels are large, there is such a fear that the ink might flow backward from the return channels and might be leaked from the nozzles, respectively.

An object of the present disclosure is to provide a liquid discharge head capable of allowing the liquid to flow sufficiently among the individual channels.

According to an aspect of the present disclosure, there is provided a liquid discharging head including: a first individual channel row including a plurality of first individual channels which are aligned in a first direction and in which a plurality of first nozzles are opened, respectively; a second individual channel row including a plurality of second individual channels which are aligned in the first direction and in which a plurality of second nozzles are opened, respectively; a first common channel extending in the first direction, connected to the plurality of first individual channels, and having a first connecting part connectable to a liquid supply source; a second common channel extending in the first direction, connected to the plurality of second individual channels, and having a second connecting part connectable to the liquid supply source; and a connecting channel arranged side by side with respect to the first and second individual channel rows in a second direction orthogonal to the first direction, and connecting the plurality of first individual channels and the plurality of second individual channels to one another. The connecting channel includes: a common connecting channel which does not have a connecting part with respect to the liquid supply source and which is communicated with the plurality of first individual channels and the plurality of second individual channels; a plurality of first individual connecting channels which correspond to the plurality of first individual channels, respectively, and each of which connects one of the plurality of first individual channels to the common connecting channel; and a plurality of second individual connecting channels which correspond to the plurality of second individual channels, respectively, and each of which connects one of the plurality of second individual channels to the common connecting channel.

DESCRIPTION OF THE EMBODIMENTS

First Embodiment

In the following, a first embodiment of the present disclosure will be explained.

<Overall Configuration of Printer 1>

Figure 1:
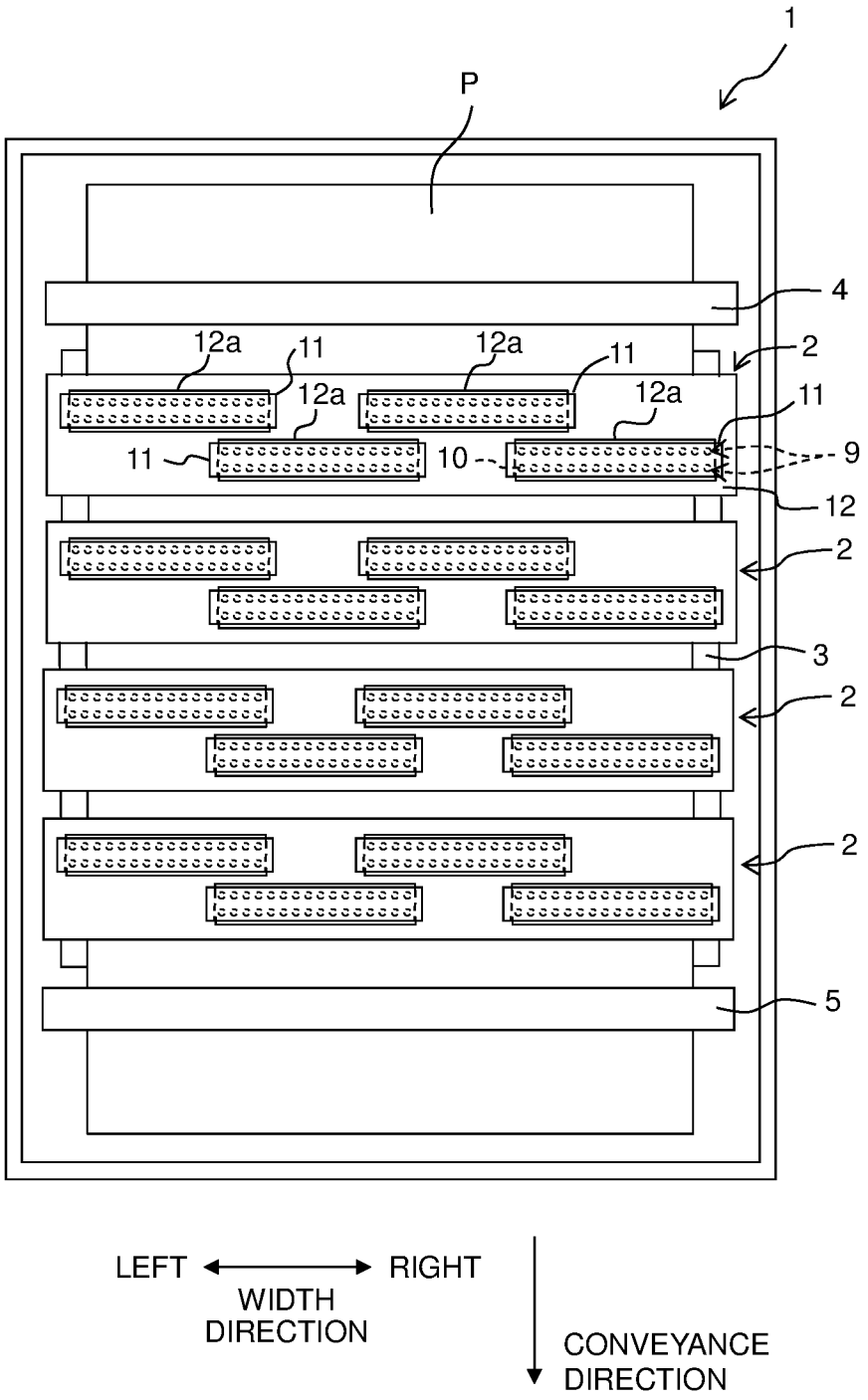
FIG. 1 is a schematic view depicting the configuration of a printer 1.

As depicted in FIG. 1, a printer 1 according to the first embodiment is provided with four ink-jet heads 2, a platen 3 and conveying rollers 4 and 5.

The four ink-jet heads 2 are arranged side by side in a conveyance direction (corresponding to a "second direction" of the present disclosure) which is horizontal and in which a recording paper sheet P is conveyed by the conveying rollers 4 and 5 as will be described later on. Each of the four ink-jet heads 2 is provided with four head units 11 (corresponding to a "liquid discharge head" of the present disclosure), and a holding member 12. Each of the head units 11 discharges or jets an ink from a plurality of nozzles 10 formed in a lower surface thereof. Here, from the plurality of nozzles 10 in the four ink-jet heads 2, black, yellow, cyan and magenta inks are discharged in this order from the upstream side in the conveyance direction.

Further, in each of the head units 11, the plurality of nozzles 10 are aligned in a width direction of the paper (corresponding to a "first direction" of the present disclosure) which is horizontal and orthogonal to the conveyance direction to thereby form a nozzle row 9. Furthermore, each of the head units 11 has two nozzle rows 9 arranged side by side in the conveyance direction. Moreover, between the two nozzle rows 9, the positions of the nozzles 10 in the width direction are shifted by half a spacing distance (interval) between the nozzles 10 in each of the nozzle rows 9. Note that the following explanation will be made, with the right side and the left side in the width direction being defined as depicted in FIG. 1.

Further, each of the ink-jet heads 2 has four head units 11. In each of the ink-jet heads 2, two head units 11 among the four head units 11 are arranged side by side in the width direction at a spacing distance (interval) therebetween. Further, in each of the ink-jet heads 2, remaining two head units 11 among the four head units 11 are also arranged side by side in the width direction at a spacing distance therebetween. Furthermore, among the four head units 11, the two head units 11 arranged side by side in the width direction and the remaining two head units 11 arranged side by side in the width direction are arranged side by side in the conveyance direction at an interval therebetween. Moreover, two head units 11 arranged on the upstream side in the conveyance direction and two head units 11 arranged on the downstream side in the conveyance direction are arranged so that the positions in the width direction thereof are shifted. Further, a part of the nozzles 10 in each of the two head units 11 arranged on the upstream side in the conveyance direction overlaps with a part of the nozzles 10 in one of the two head units 11 arranged on the downstream side in the conveyance direction. With this, the plurality of nozzles 10 of the four head units 11 are arranged in the width direction over the entire length of the recording paper sheet P. Namely, each of the ink-jet heads 2 is a so-called line head extending in the width direction over the entire length of the recording paper sheet P.

The holding member 12 is a plate-like member which has a rectangular shape and of which longitudinal direction is the width direction; the four head units 11 are fixed to the holding member 12. Further, the holding member 12 is formed with four through holes 12*a* having a rectangular shape and corresponding to the four head units 11, respectively. The plurality of nozzles 10 in the four head units 11 are exposed to the lower side (the side of the recording paper sheet P) via the four through holes 12*a* corresponding thereto respectively.

The platen 3 is arranged at a location below the four the ink-jet heads 2, and faces (is opposite to) the plurality of nozzles 10 of the four head units 2. The platen 3 supports the recording paper sheet P from therebelow. The conveying roller 4 is arranged on the upstream side in the conveyance direction of the four ink-jet heads 2 and the platen 3. The conveying roller 5 is arranged on the downstream side in the conveyance direction of the four ink-jet heads 2 and the platen 3. The conveying rollers 4 and 5 convey the recording paper sheet P in the conveyance direction.

Further, in the printer 1, recording is performed with respect to the recording paper P by discharging (jetting) the inks onto the recording paper sheet P from the plurality of nozzles 10 of the four head units 11 of the respective four ink-jet heads 2, while conveying the recording paper sheet P in the conveyance direction by the conveying rollers 4 and 5.

<Head Unit 11>

Figure 2:
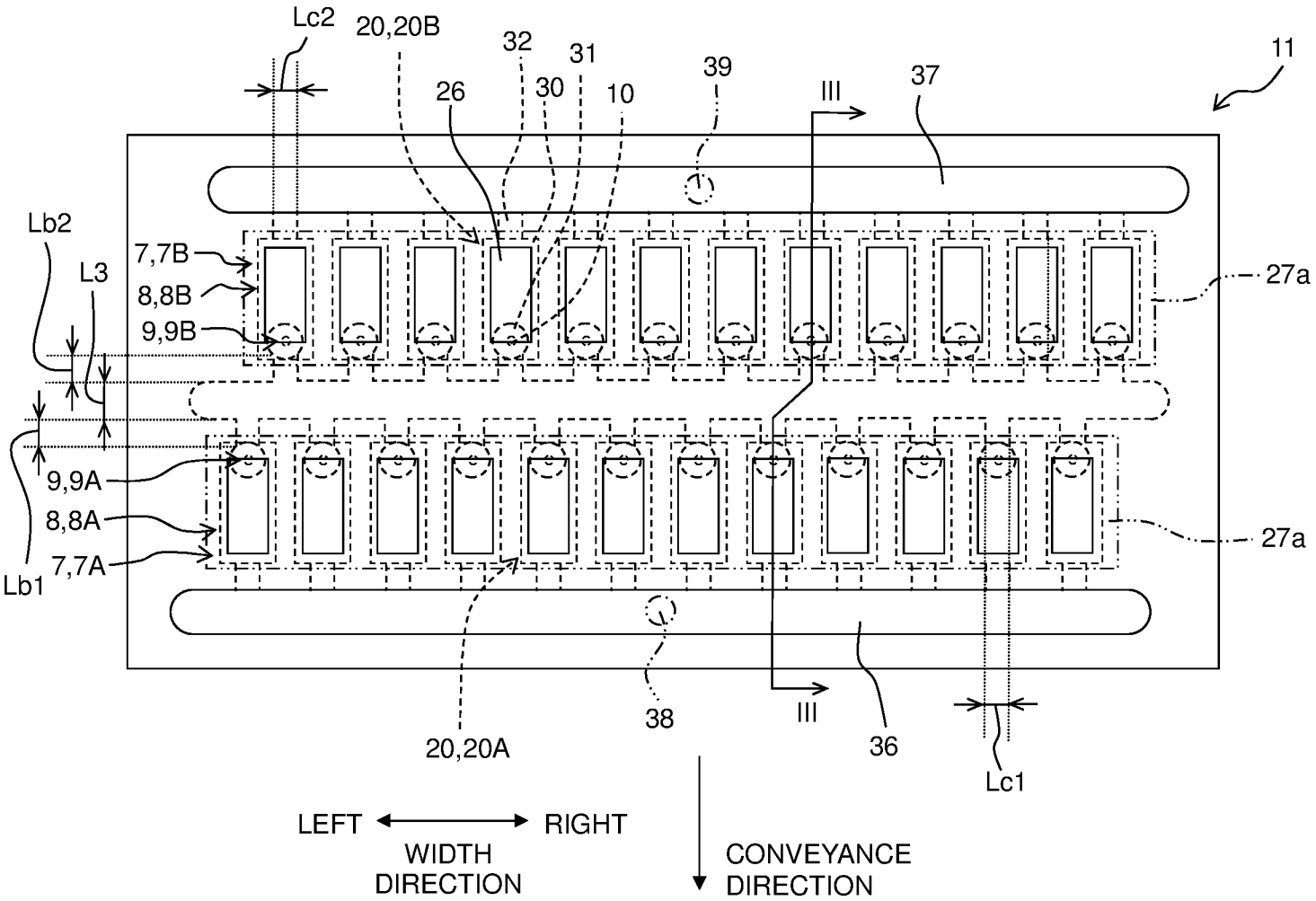
FIG. 2 is a plan view of a head unit 11.
Figure 3:
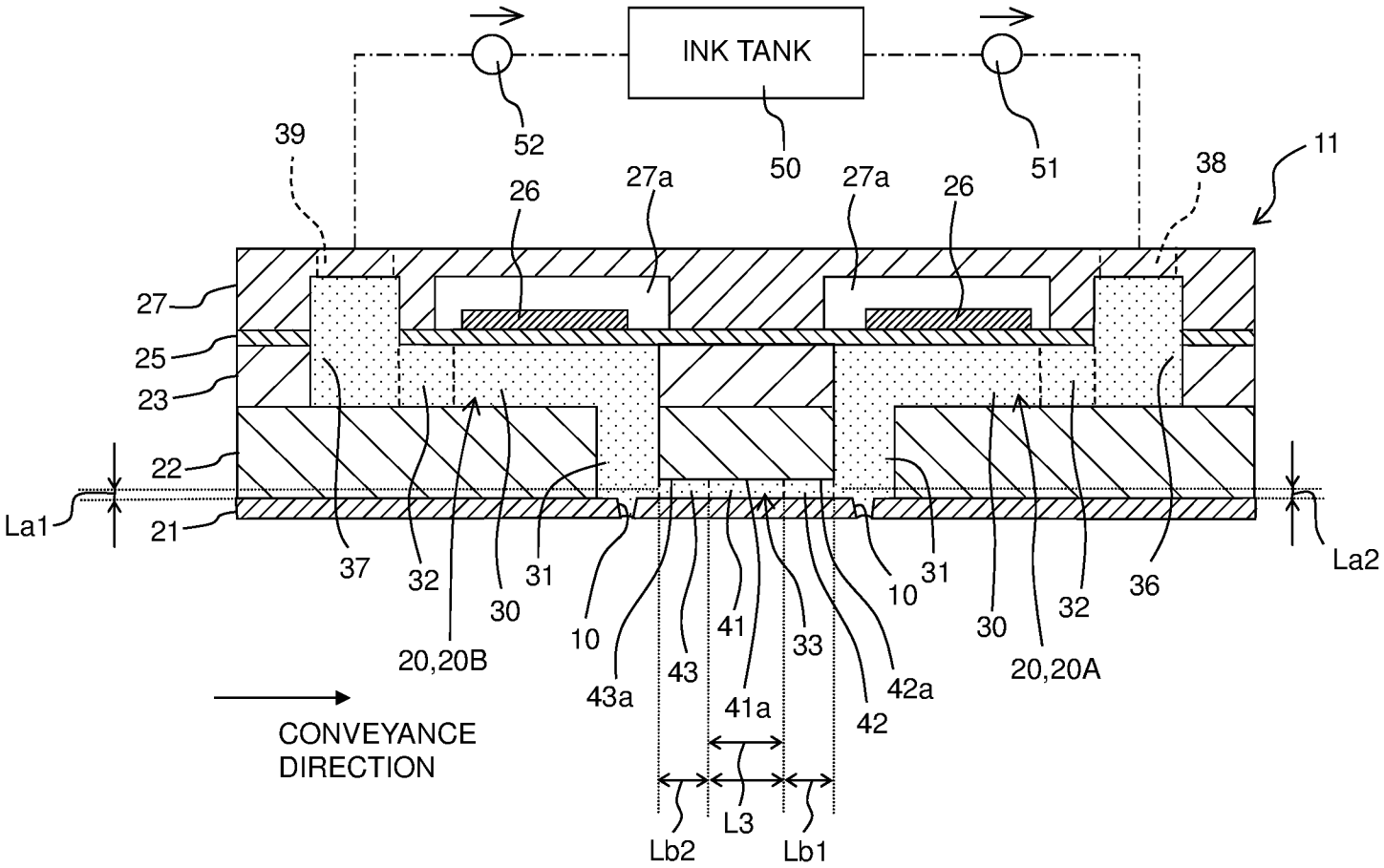
FIG. 3 is a cross-sectional taken along a line III-III in FIG. 2.

Next, the head units 11 will be explained in detail. As depicted in FIGS. 2 and 3, each of the head units 11 is provided with plates 21 to 23, a vibration plate 25, a plurality of piezoelectric elements 26 and a protective member 27.

The plates 21 to 23 are stacked on top of one another in this order from a lower position in an up-down direction (corresponding to a "third direction" of the present disclosure). The plate 21 is formed, for example, of a synthetic resin such as polyimide, etc. Each of the plates 22 and 23 is formed, for example, of silicon (Si). A stacked body of the plates 21 to 23 is formed with a plurality of nozzles 10, a plurality of pressure chambers 30, a plurality of descenders 31, a plurality of throttle portions 32, and a connecting channel 33.

The plurality of nozzles 10 are formed in the plate 21. The plurality of nozzles 10 form the above-described two nozzle rows 9. Note that in the first embodiment, nozzles 10, among the plurality of nozzles 10, which construct a nozzle row 9 located on the downstream side in the conveyance direction (hereinafter also referred to a "nozzle row 9A" in some cases) among the two nozzle rows 9 correspond to "first nozzles" of the present disclosure; and nozzles 10, among the plurality of nozzles 10, which construct a nozzle row 9 located on the upstream side in the conveyance direction (hereinafter also referred to a "nozzle row 9B" in some cases) among the two nozzle rows 9 correspond "second nozzles" of the present disclosure.

The plurality of pressure chambers 30 correspond to the plurality of nozzles 10, respectively. The plurality of pressure chambers 30 are formed in the plate 23. Each of the plurality of pressure chambers 30 has a shape projected in the up-down direction which is a rectangle and of which longitudinal direction is the conveyance direction.

Further, each of the plurality of nozzles 10 overlaps, in the up-down direction, with an end part on one side in the conveyance direction of one of the plurality of pressure chambers 30. To provide more detailed explanation, each of the nozzles 10 constructing the nozzle row 9A overlaps, in the up-down direction, with an end part on the upstream side in the conveyance direction of one of the plurality of pressure chambers 30 corresponding thereto. Further, each of the nozzles 10 constructing the nozzle row 9B overlaps, in the up-down direction, with an end part on the downstream side in the conveyance direction of one of the plurality of pressure chambers 30 corresponding thereto. With this, in the plate 23, the plurality of pressure chambers 30 are aligned in the width direction to thereby form two pieces of a pressure chamber row 8 which are arranged side by side in the conveyance direction. Further, in the first embodiment, pressure chambers 30, among the plurality of pressure chambers 30, constructing a pressure chamber row 8 on the downstream side in the conveyance direction (hereinafter also referred to as a "pressure chamber row 8A" in some cases) among the two pressure chamber rows 8 correspond to "first pressure chambers" of the present disclosure; and pressure chambers 30, among the plurality of pressure chambers 30, constructing a pressure chamber row 8 on the upstream side in the conveyance direction (hereinafter also referred to as a "pressure chamber row 8B" in some cases) among the two pressure chamber rows 8 correspond to "second pressure chambers" of the present disclosure.

The plurality of descenders 31 correspond to the plurality of nozzles 10, respectively, and are formed in the plate 22. Each of the plurality of descenders 31 extends in the up-down direction and connects one of the plurality of nozzles 10 and one of the plurality of pressure chambers 30 corresponding thereto. Note that in the first embodiment, descenders 31, among the plurality of descenders 31, corresponding to the nozzle row 9A and the pressure chamber row 8A correspond to "first descenders" of the present disclosure; and descenders 31, among the plurality of descenders 31, corresponding to the nozzle row 9B and the pressure chamber row 8B correspond to "second descenders" of the present disclosure.

The plurality of throttle portions 32 correspond to the plurality of pressure chambers 30, respectively, and are formed in the plate 23. Each of the plurality of throttle portions 32 extends in the conveyance direction, and a part on one side of each of the throttle portions 32 is connected to an end, of one of the pressure chambers 30, on a side opposite to the nozzle 10. Further, each of the plurality of throttle portions 32 has a length in the width direction which is shorter than that of one of the plurality of pressure chambers 30. Accordingly, each of the plurality of throttle portions 32 has a channel resistance greater than that of one of the plurality of pressure chamber 30.

Further, a certain nozzle 10 among the plurality of nozzles 10, and one of the plurality of pressure chambers 30, one of the plurality of descenders 31 and one of the plurality of throttle portions 32 which correspond to the certain nozzle 10 form an individual channel 20. Furthermore, in the head unit 11, two individual channel rows 7, each of which is formed of a plurality of pieces of the individual channel 20 aligned in the width direction, are arranged side by side in the conveyance direction. Note that in the following description, an individual channel row 7 located on the downstream side in the conveyance direction (hereinafter also referred to an "individual channel row 7A" in some cases) among the two individual channel rows 7 correspond to a "first individual channel row" of the present disclosure; an individual channel row 7 located on the upstream side in the conveyance direction (hereinafter also referred to an "individual channel row 7B" in some cases) among the two individual channel rows 7 correspond to a "second individual channel row" of the present disclosure. Further, individual channels 20, among the plurality of individual channels 20, constructing the individual channel row 7A (hereinafter also referred to "individual channels 20A" in some cases) correspond to "first individual channels" of the present disclosure; and individual channels 20, among the plurality of individual channels 20, constructing the individual channel row 7B (hereinafter also referred to "individual channels 20B" in some cases) correspond to "second individual channels" of the present disclosure.

The connecting channel 33 has one common connecting channel 41, a plurality of individual connecting channels 42 (corresponding to "first individual connecting channels" of the present disclosure), and a plurality of individual connecting channels 43 (corresponding to "second individual connecting channels" of the present disclosure). The common connecting channel 41 is formed in a lower end part of the plate 22, and is located between the plurality of individual connecting channels 20A and the plurality of individual connecting channels 20B in the conveyance direction. Further, the common connecting channel 41 extends in the width direction along the entire lengths of the individual channel rows 7A and 7B. Note that the common connecting channel 41 does not have any connecting part with respect to an ink tank 50 (to be described later on), unlike manifolds 36 and 37 (to be described later on).

The plurality of individual connecting channels 42 correspond to the plurality of individual channels 20A, respectively, and are formed in the lower end part of the plate 22. Each of the individual connecting channels 42 extends in the conveyance direction and connects a lower end part of each of the descenders 31 of the individual channels 20A with the common connecting channel 41.

The plurality of individual connecting channels 43 correspond to the plurality of individual channels 20B, respectively, and are formed in the lower end part of the plate 22. Each of the individual connecting channels 43 extends in the conveyance direction and connects a lower end part of each of the descenders 31 of the individual channels 20B with the common connecting channel 41.

Further, the common connecting channel 41, the plurality of individual connecting channels 42 and the plurality of individual connecting channels 43 are formed at parts, of the plate 22, which are located at a same height, and have length in the up-down direction which are same with one another. With this, a ceiling surface 41*a* of the common connecting channel 41, a ceiling surface 42 of each of the plurality of individual connecting channels 42 and a ceiling surface 43*a* of each of the plurality of individual connecting channels 43 are located on a same plane which is parallel to the width direction and the conveyance direction.

Further, in the conveyance direction, a length Lb1 of each of the plurality of individual connecting channels 42 and a length Lb2 of each of the plurality of individual connecting channels 43 are made to be shorter than a length L3 of the common connecting channel 41. Furthermore, the length L3 in the conveyance direction of the common connecting channel 41 is made to be longer than a length Lc1 in the width direction of each of the plurality of individual connecting channels 42 and a length Lc2 in the width direction of each of the plurality of individual connecting channels 43.

Here, provided that, a length La1 is a length in the up-down direction between the center in the up-down direction of a connecting part of each of the plurality of descenders 31 with respect to one of the plurality of first individual connecting channels 42, and one of the plurality of nozzles 10; and a length La2 is a length in the up-down direction between the center in the up-down direction of a connecting part of each of the plurality of descenders 31 with respect to one of the plurality of first individual connecting channels 43, and one of the plurality of nozzles 10. Further, V is velocity of propagation of pressure wave in a liquid in a case that a piezoelectric element 26 is driven as will be described later on; and T is a period of the pressure wave. In this case, a relationship $|La1-Lb1|=n1\times V\times T$ holds, and a relationship $|La2-Lb2=n2\times V\times T$ holds. In these relationships, n1 and n2 are each a natural number.

The vibration plate 25 is arranged on the upper surface of the plate 23, and covers the plurality of pressure chambers 30. The vibration plate 25 is formed, for example, of silicon dioxide ($SiO_2$) or silicon nitride (SiN). The vibration plate 25 is formed, for example, by oxidizing or nitriding an upper end part of the plate 23.

A plurality of piezoelectric elements 26 correspond to the plurality of pressure chambers 30, respectively. Each of the plurality of piezoelectric elements 26 is arranged in a part, of the upper surface of the vibration plate 25, overlapping in the up-down direction with one of the plurality of pressure chambers 30 corresponding thereto. Here, each of the plurality of piezoelectric elements 26 is formed of: a piezoelectric body formed of a piezoelectric material containing, as a main component thereof, lead zirconate titanate which is a mixed crystal of lead titanate and lead zirconate; and electrodes sandwiching the piezoelectric body therebetween in the up-down direction. Further, in a case that any difference in the potential is generated in the electrodes sandwiching the piezoelectric body therebetween so that an electric field is generated in the piezoelectric body, thereby deforming the piezoelectric body piezoelectrically. This deforms each of the piezoelectric elements 26 and a part of the vibration plate 25 which overlaps, in the up-down direction, with a certain pressure chamber 30 among the plurality of the pressure chambers 30 corresponding to each of the piezoelectric elements 26 thereby changing the volume of the certain pressure chamber 30 and thus causing the pressure in the ink inside the certain pressure chamber 30 to vary or change. As a result, ink is jetted or discharged from a certain nozzle 10 included in the nozzles 10 and corresponding to the certain pressure chamber 30. Note, however, that the construction per se of the piezoelectric element 26 is similar to that of a conventional piezoelectric element, and thus any further detailed explanation therefor will be omitted.

The protective member 27 is formed, for example, of silicon (Si), and is arranged on the upper surface, of the vibration plate 25, on which the plurality of piezoelectric elements 26 are arranged. Two recessed parts 27*a* corresponding to the two pressure chamber rows 7, respectively, are formed in the lower surface of the protective member 27. Each of the two recessed parts 27*a* extends in the width direction; the plurality of piezoelectric elements 26 corresponding to the respective individual channel rows 7 are accommodated in the inside of the recessed parts 27*a* corresponding to the pressure chamber rows 7, respectively.

Further, the head unit 11 has a first manifold 36 (corresponding to a "first common channel" of the present disclosure) and a second manifold 37 (corresponding to a "second common channel" of the present disclosure). The first manifold 36 extends, in the up-down direction in a lower part of the protecting member 27, the plate 23 and the vibration plate 25. Further, the first manifold 36 is located on the downstream side in the conveyance direction of the plurality of individual channels 20A, and extends in the width direction along the entire length of the individual channel row 7A. Furthermore, ends on the downstream side in the conveyance direction of the plurality of throttle portions 32 of the plurality of individual channels 20A are connected to the first manifold 36.

The second manifold 37 extends, in the up-down direction in the lower part of the protecting member 27, the plate 23 and the vibration plate 25. Further, the second manifold 37 is located on the upstream side in the conveyance direction of the plurality of individual channels 20B, and extends in the width direction along the entire length of the individual channel row 7B. Furthermore, ends on the upstream side in the conveyance direction of the plurality of throttle portions 32 of the plurality of individual channels 20B are connected to the second manifold 37.

Moreover, a supply channel 38 is formed in an upper part of the protecting member 27, at a location overlapping, in the up-down direction, with a central part in the width direction of the first manifold 36. A lower end of the supply channel 38 is connected to the first manifold 36. Further, an upper end of the supply channel 38 is connected to an ink tank 50 (corresponding to a "liquid supply source" of the present disclosure) via a non-depicted channel. Furthermore, a pump 51 is provided on a channel between the supply channel 38 and the ink tank 50. The pump 51 feds the ink from the ink tank 50 toward the supply channel 38. Note that in the first embodiment, a connecting part of the first manifold 36 at which the first manifold 36 is connected to the supply channel 38 corresponds to a "first connecting part" of the present disclosure.

Moreover, a discharge channel 39 is formed in the upper part of the protecting member 27, at a location overlapping, in the up-down direction, with a central part in the width direction of the second manifold 37. A lower end of the discharge channel 39 is connected to the second manifold 37. Further, an upper end of the discharge channel 39 is connected to the ink tank 50 via a non-depicted channel. Furthermore, a pump 52 is provided on a channel between the discharge channel 39 and the ink tank 50. The pump 52 feds the ink from the discharge channel 39 toward the ink tank 50. Note that in the first embodiment, a connecting part of the second manifold 37 at which the second manifold 37 is connected to the discharge channel 39 corresponds to a "second connecting part" of the present disclosure.

Moreover, in a case that the pumps 51 and 52 are driven, the ink inside the ink tank 50 is allowed to flow into the first manifold 36 via the supply channel 38. The ink inside the first manifold 36 flows from the plurality of throttle portions 32 into the plurality of individual channels 20A, respectively. The ink inside the plurality of individual channels 20A flows, via the plurality of individual connecting channels 42, respectively, into the common connecting channel 41, and further flows into the plurality of individual channels 20B via the plurality of individual connecting channels 43, respectively. The ink inside the plurality of individual channels 20B flows from the plurality of throttle portions 32, respectively, into the second manifold 37. The ink inside the second manifold 37 is discharged from the discharge channel 39, and returns to the ink tank 50. With this, the ink is circulated between the head unit 11 and the ink tank 50. Note that it is allowable that only one of the pumps 51 and 52 is provided. In such a case also, it is possible to circulate the ink in a similar manner as described above.

<Effects of First Embodiment>

In the first embodiment, the common connecting channel 41, which is common to the plurality of individual connecting channels 42 corresponding to the plurality of individual channels 20A, respectively, and the plurality of individual connecting channel 43 corresponding to the plurality of individual channels 20B, respectively, is provided between the plurality of individual connecting channels 42 and the plurality of individual connecting channels 43. With this, the channel resistance of the connecting channel 33 connecting the plurality of individual channels 20A and the plurality of individual channels 20B is made to be small, thereby making it possible to cause the ink to flow sufficiently between the plurality of individual channels 20A and the plurality of individual channels 20B via the connecting channel 33.

Further, since the channel resistance of the connecting channel 33 is small, the ink flows easily into the connecting channel 33, while avoiding such a situation that the ink leaks from the nozzles 10.

Further, in the first embodiment, each of the individual connecting channels 42 is connected to one of the descenders 31 of the individual channels 20A, and each of the individual connecting channels 43 is connected to one of the descenders 31 of the individual channels 20B. With this, it is possible to flow the ink sufficiently between the descenders 31 of the plurality of individual channels 20A and the descenders 31 of the plurality of individual channels 20B, via the connecting channel 33.

Furthermore, in the first embodiment, the plurality of individual connecting channels 42 are connected to the lower end parts of the descenders 31 of the individual channels 20A, respectively, and the plurality of individual connecting channels 43 are connected to the lower end parts of the descenders 31 of the individual channels 20B, respectively. Moreover, the positions and length in the up-down direction are all same in (among) the common connecting channel 41 and the plurality of individual connecting channels 42 and the plurality of individual connecting channels 43; the common connecting channel 41 has no parts which are located below the plurality of individual connecting channels 42 and the plurality of individual connecting channels 43. With this, it is possible allow each of the plurality of individual connecting channels 42 and the plurality of individual connecting channels 43 to be connected to a part, in the descender 31, which is located closely to the nozzle 10 in the up-down direction as much as possible. As a result, it is possible to discharge any air bubble, inflowing into the descender 31 of each of the individual channels 20A from the nozzle of each of the individual channel 20A, effectively to the second manifold 37 via the connecting channel 33 and one of the individual channels 20B. Further, in a case that ink is circulated between the head unit 11 and the ink tank 50, the ink is allowed to flow in the part, of the descender 31, which is close to the nozzle 10, thereby making it possible to suppress any drying of the ink inside the nozzle 10.

Further, in the first embodiment, the relationship $|La1-Lb1=n1\times V\times T$ holds, and the relationship $|La2-Lb2|=n2\times V\times T$ holds. With this, a pressure wave propagating in the inside of the descender 31 from the pressure chamber 30 toward the nozzle 10, and a pressure wave propagating from the descender 31 toward the individual connecting channel 42, 43 and reflected off the connecting part at which the individual connecting channel 42, 43 is connected to the common connecting channel 41 and returning back to the descender 31 do not become to be inverse phases to each other, do not cancel each other out and are not attenuated. With this, it is possible to avoid such a situation that the ink cannot be normally discharged from the nozzle 10.

Furthermore, in the first embodiment, the ceiling surface 41*a* of the common connecting channel 41 and the ceiling surface 42*a* of each of the plurality of individual connecting channels 42 and the ceiling surface 43*a* of each of the plurality of individual connecting channels 43 are located on the same horizontal plane. Accordingly, any air bubble inside the connecting channel 33 flows smoothly along the ceiling surfaces 41*a* to 43*a* between the common connecting channel 41 and the individual connecting channels 42 and 43. With this, it is possible to avoid such a situation that the air bubble remains or accumulates in the inside of the connecting channel 33.

Moreover, in the first embodiment, with respect to such a configuration that the individual channel row 7A and the individual channel row 7B are arranged in the conveyance direction at the interval therebetween, it is possible to arrange the connecting channel 33, which includes the common connecting channel 41 which extends in the width direction along the entire length of the individual channel rows 7A and 7B and of which volume is allowed to be large, between the individual channel rows 7A and 7B in the conveyance direction.

Further, in the first embodiment, the length L3 in the conveyance direction of the common connecting channel 41 is made to be longer than the length Lc1 in the width direction of each of the plurality of individual connecting channels 42 and the length Lc2 in the width direction of each of the plurality of individual connecting channels 43. With this, it is possible to make the volume of the common connecting channel 41 to be large, and to make the channel resistance in the connecting channel 33 as a whole to be small.

Furthermore, in the first embodiment, the length Lb1 in the conveyance direction of each of the plurality of individual connecting channels 42 and the length Lb2 in the conveyance direction of each of the plurality of individual connecting channels 43 are made to be shorter than the length L3 in the conveyance direction of the common connecting channel 41. With this, in the conveyance direction, the lengths of the individual channels 42 and 43 of which channel resistance is large is made to be short, and the length of the common connecting channel 41 of which channel resistance is small is made to be long, thereby making it possible to make the channel resistance of the connecting channel 33 as a whole to be small as much as possible.

Second Embodiment

Next, a second embodiment of the present disclosure will be explained. The second embodiment has such a configuration wherein the head unit 11 in the first embodiment is replaced by a head unit 100.

<Head Unit 100>

Figure 4:
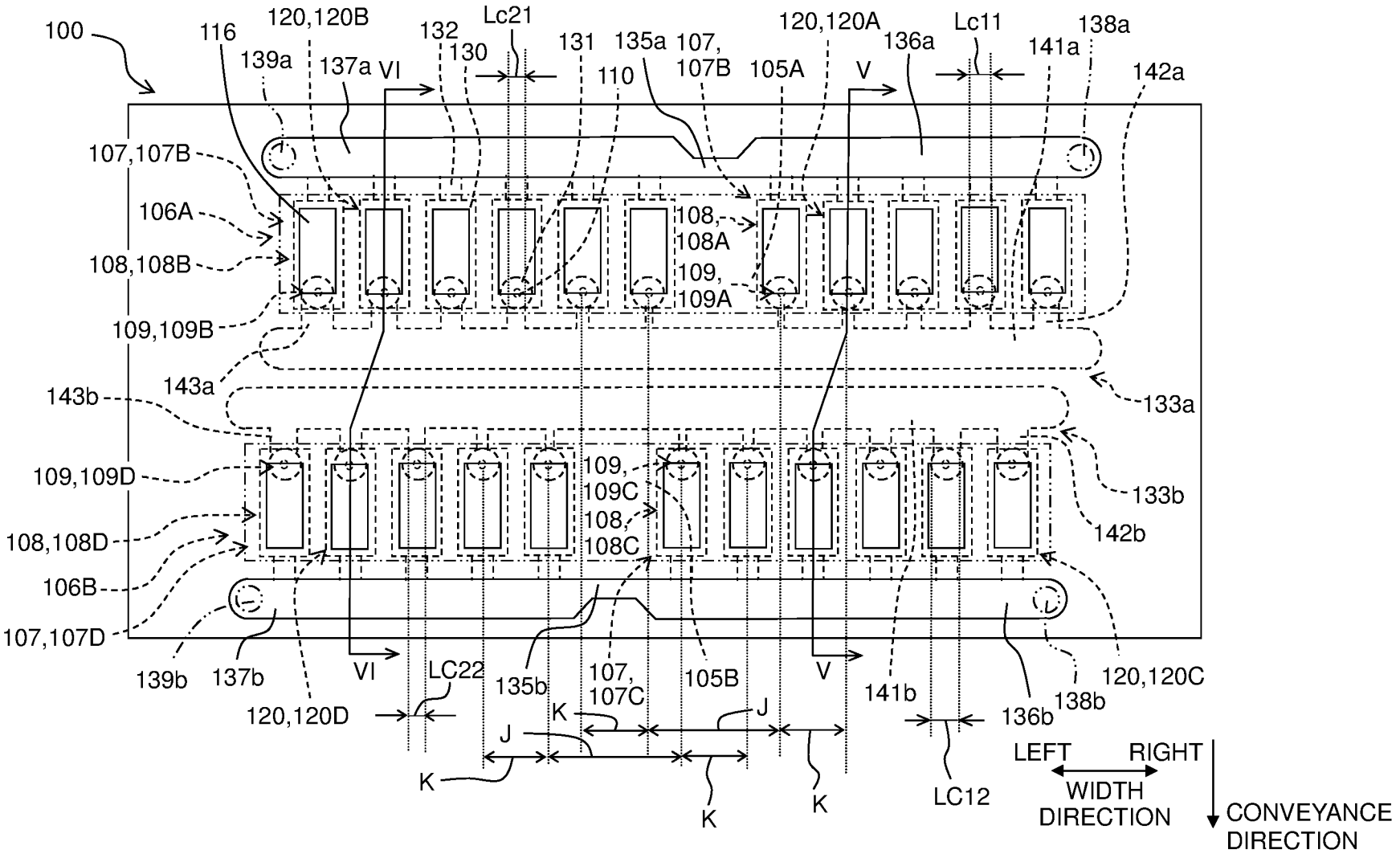
FIG. 4 is a plan view of a head unit 100.
Figure 5:
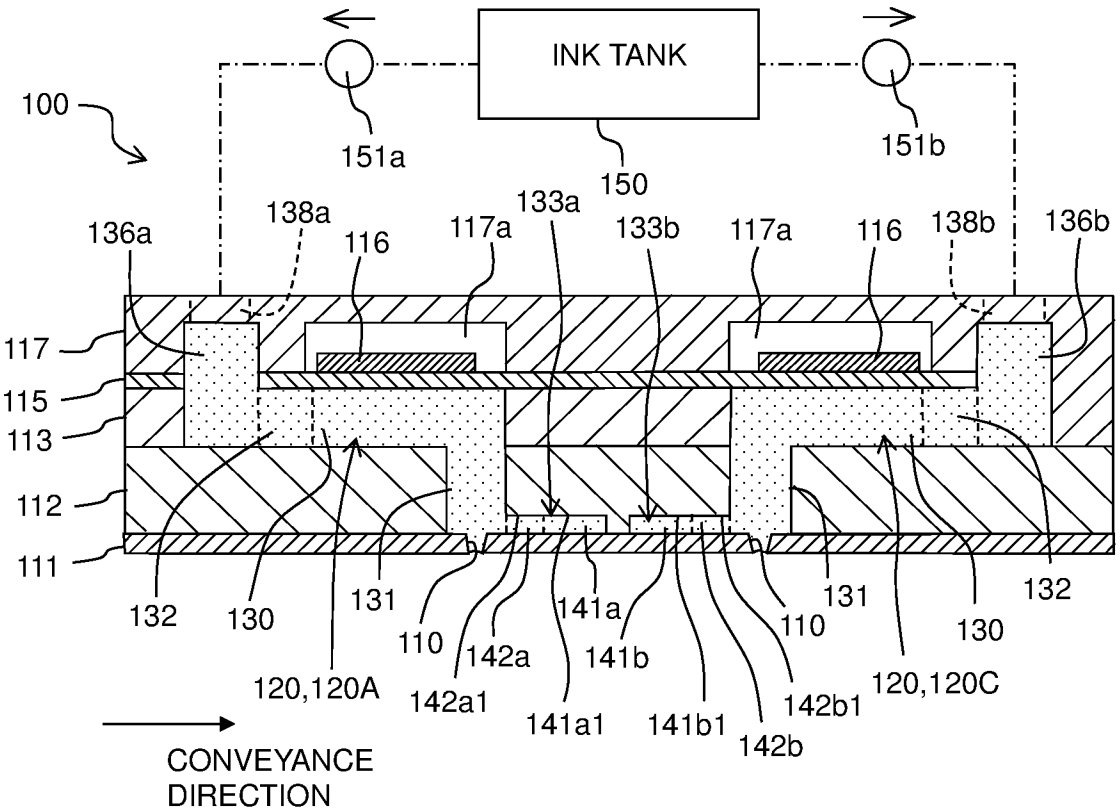
FIG. 5 is a cross-sectional taken along a line V-V in FIG. 4.
Figure 6:
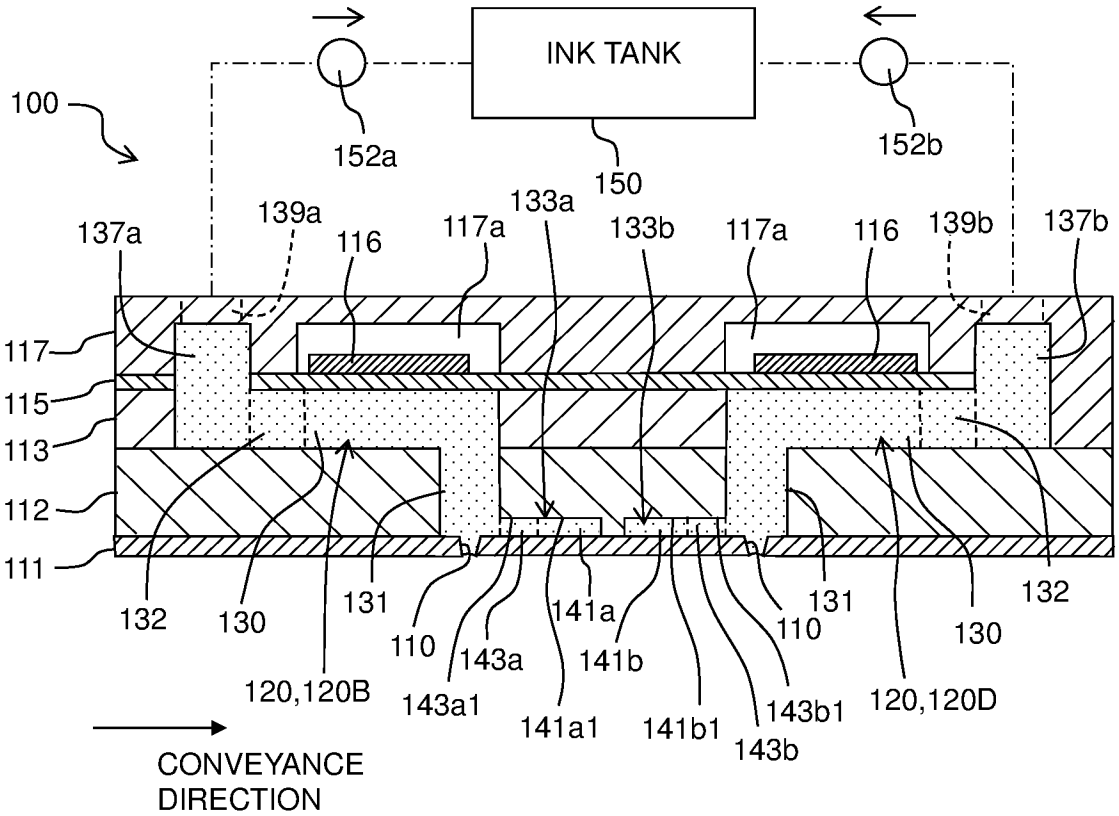
FIG. 6 is a cross-sectional taken along a line VI-VI in FIG. 4.

As depicted in FIGS. 4 to 6, the head units 100 is provided with a plurality of plates 111 to 113, a vibration plate 115, a plurality of piezoelectric elements 116 and a protective member 117.

The plurality of plates 111 to 113 are stacked on top of one another in this order from a lower position in the up-down direction. The plate 111 is formed, for example, of a synthetic resin material such as polyimide, etc. Each of the plates 112 and 113 is formed, for example, of silicon (Si). A stacked body of the plates 111 to 113 is formed with a plurality of nozzles 100, a plurality of pressure chambers 130, a plurality of descenders 131, a plurality of throttles 132, and two connecting channels 133*a* and 133*b*.

The plurality of nozzles 110 are formed in the plate 111. Further, the plate 111 has four nozzle rows 109 (109A, 109B, 109C and 109D) each of which is formed by aligning nozzles 110, among the plurality of nozzles 110, in the width direction.

The nozzle row 109B is arranged on the left side in the width direction of the nozzle row 109A, and nozzles 110, among the plurality of nozzles 110, which construct the nozzle row 109A and nozzles 110, among the plurality of nozzles 110, which construct the nozzle row 109B are aligned in the width direction to form a row. Note, however, that a spacing distance (gap) J between a leftmost nozzle 110 located on the leftmost side among the nozzles 110 constructing the nozzle row 109A and a rightmost nozzle 110 located on the rightmost side among the nozzles 110 constructing the nozzle row 109B is m times (m is an integer of not less than 2 (two), in FIG. 4, m=2) a spacing distance K between the nozzles 110 in each of the nozzle rows 109A and 109B.

The nozzle rows 109C and 109D are arranged on the downstream side in the conveyance direction of the nozzle rows 109A and 109B. The nozzle row 109D is arranged on the left side in the width direction of the nozzle row 109C; and nozzles 110, among the plurality of nozzles 110, constructing the nozzle row 109C and nozzles 110, among the plurality of nozzles 110, constructing the nozzle row 109D are aligned in the width direction to form a row. Note, however, that a spacing distance (gap) J between a leftmost nozzle 110 located on the leftmost side among the nozzles 110 constructing the nozzle row 109C and a rightmost nozzle 110 located on the rightmost side among the nozzles 110 constructing the nozzle row 109D is m times (m is an integer of not less than 2 (two), in FIG. 4, m=2) a spacing distance K between the nozzles 110 in each of the nozzle rows 109C and 109D.

Further, the nozzles 110 constructing the nozzle rows 109C and 109D are shifted relative to the nozzles 110 constructing the nozzle rows 109A and 109B, only by a length which is half the spacing distance K among the nozzles 110 in each of the nozzle rows 109A to 109D. Further, the number of the nozzles 110 constructing the nozzle row 109C is greater than the number of the nozzles 110 constructing the nozzle row 109A; and the number of the nozzles 110 constructing the nozzle row 109D is smaller than the number of the nozzles 110 constructing the nozzle row 109B.

With this, a position in the width direction of an area 105A between the nozzle row 109A ("individual channel row 107A" which will be described later on) and the nozzle row 109B ("individual channel row 107B" which will be described later on) is different from a position in the width direction of an area 105B between the nozzle row 109C ("individual channel row 107C" which will be described later on) and the nozzle row 109D ("individual channel row 107D" which will be described later on). Further, the nozzles 110 constructing the nozzle row 109C is located at a position in the width direction between the nozzle row 109A and the nozzle row 109B. Furthermore, the nozzles 110 constructing the nozzle row 109B is located at a position in the width direction between the nozzle row 109C and the nozzle row 109D.

Note that in the second embodiment, the nozzles 110 which construct the nozzle rows 109A and 109C correspond to "first nozzles" of the present disclosure; and the nozzles 110 which construct the nozzle rows 109B and 109D correspond to "second nozzles" of the present disclosure.

The plurality of pressure chambers 130 correspond to the plurality of nozzles 110, respectively. The plurality of pressure chambers 130 are formed in the plate 113. Each of the plurality of pressure chambers 130 has a shape similar to the shape of the pressure chamber 30. Further, similarly to the first embodiment, each of the plurality of nozzles 110 overlaps, in the up-down direction, with an end part on one side in the conveyance direction of one of the plurality of pressure chambers 130. With this, in the plate 113, the plurality of pressure chambers 130 are aligned in the width direction to thereby form four pieces of a pressure chamber row 108 (pressure chamber rows 108A, 108B, 108C and 108D). Note that in the second embodiment, pressure chambers 130, among the plurality of pressure chambers 130, constructing the pressure chamber rows 109A and 108C correspond to "first pressure chambers" of the present disclosure; and pressure chambers 130, among the plurality of pressure chambers 130, constructing the pressure chamber rows 108B and 108D correspond to "second pressure chambers" of the present disclosure.

The plurality of descenders 131 correspond to the plurality of nozzles 110, respectively, and are formed in the plate 112. Each of the plurality of descenders 131 extends in the up-down direction and connects one of the plurality of nozzles 110 and one of the plurality of pressure chambers 130 corresponding thereto. Note that in the second embodiment, descenders 131, among the plurality of descenders 131, corresponding to the nozzle rows 109A and 109C correspond to "first descenders" of the present disclosure; and descenders 131, among the plurality of descenders 131, corresponding to the nozzle rows 109B and 109D correspond to "second descenders" of the present disclosure.

The plurality of throttles 132 correspond to the plurality of pressure chambers 130, respectively, and are formed in the plate 113. Each of the plurality of throttles 132 extends in the conveyance direction, and a part on one side in the conveyance direction of each of the plurality of throttles 132 is connected to an end, of one of the pressure chambers 130, on a side opposite to the nozzle 110.

Further, a certain nozzle 110 among the plurality of nozzles 110, and one of the plurality of pressure chambers 130, one of the plurality of descenders 131, and one of the plurality of throttles 132 which correspond to the certain nozzle 110 form an individual channel 120. Furthermore, the head unit 100 has four individual channel rows 107 (107A, 107B, 107C and 107D) each of which is formed by aligning a plurality of pieces of the individual channel 120 in the width direction. Note that in the following description, the plurality of individual channels 102 constructing the individual channel rows 107A, 107B, 107C and 107D are also referred to as "individual channels 120A, 120B, 120C and 120D", respectively. In the second embodiment, the individual channel rows 107A and 107C correspond to a "first individual channel row" of the present disclosure; and the individual channel rows 107B and 107D correspond to a "second individual channel row" of the present disclosure. Furthermore, the individual channels 120A and 102C correspond to "first individual channels" of the present disclosure; and individual channels 120B and 120D correspond to "second individual channels" of the present disclosure.

Moreover, in the following explanation, a row in which the individual channel row 107A and the individual channel row 107B are combined and in which a plurality of pieces of the individual channel 120 are aligned (arranged side by side) in the width direction are collectively referred to as a synthetized individual channel row 106A, in some cases. Further, a row in which the individual channel row 107C and the individual channel row 107D are combined and in which a plurality of pieces of the individual channel 120 are aligned (arranged side by side) in the width direction is collectively referred to as a synthetized individual channel row 106B, in some cases. Note that, in the second embodiment, the synthetized individual channel rows 106A and 106B each correspond to an "individual channel row" of the present disclosure.

The connecting channel 133*a* is provided with respect to the synthetized individual channel row 106A (individual channel rows 107A, 107C). The connecting channel 133*a* has one common connecting channel 141*a*, a plurality of individual connecting channels 142*a*, and a plurality of individual connecting channels 143*a*. The common connecting channel 141*a* is formed in a lower end part of the plate 112, and is located between the synthetized individual channel rows 106A and 106B in the conveyance direction. Further, the common connecting channel 141*a* extends in the width direction along the entire length of the synthetized individual channel row 106A. Furthermore, the common connecting channel 141*a* has a length in the conveyance direction which is constant regardless of a position in the width direction, and thus has a cross-sectional area, of a cross section orthogonal to the width direction, which is constant. With this, the common connecting channel 141*a* has channel resistance per unit length which is constant regardless of the position in the width direction. Note that the common connecting channel 141*a* does not have any connecting part with respect to the ink tank 150, unlike manifolds 136*a* and 137*a* which will be described later on.

The plurality of individual connecting channels 142*a* correspond to the plurality of individual channels 120A, respectively, and are formed in the lower end part of the plate 122. Each of the individual connecting channels 142*a* extends in the conveyance direction and connects a lower end part of one of the descenders 131 of the individual channels 120A with the common connecting channel 141*a*. Further, in the plurality of individual connecting channels 142*a*, a length Lc11 in the width direction of a certain individual connecting channel 142*a* among the individual connecting channels 142*a* becomes shorter as the certain individual connecting channel 142*a* is located more closely to the left side in the width direction (to the side of the individual channel row 107B), thereby making a cross-sectional area, of a cross section orthogonal to the conveyance direction, of the certain individual connecting channel 142*a* among the plurality of individual connecting channels 142*a* to be smaller as the certain individual connecting channel 142*a* is located more closely to the left side in the width direction (to the side of the individual connecting channel row 107B). With this, in the plurality of individual connecting channels 142*a*, the channel resistance of the certain individual connecting channel 142*a* among the plurality of individual connecting channel 142*a* becomes greater as the certain individual connecting channel 142*a* is located, in the width direction, more closely to the left side (to the side of the individual connecting channel row 107B).

The plurality of individual connecting channels 143*a* correspond to the plurality of individual channels 120B, respectively, and are formed in the lower end part of the plate 122. Each of the individual connecting channels 143*a* extends in the conveyance direction and connects a lower end part of one of the descenders 131 of the individual channels 120B with the common connecting channel 141*a*. Further, in the plurality of individual connecting channels 143*a*, a length Lc21 in the width direction of a certain individual connecting channel 143*a* among the individual connecting channels 143*a* becomes shorter as the certain individual connecting channel 143*a* is located more closely to the right side in the width direction (to the side of the individual channel row 107A), thereby making a cross-sectional area, of a cross section orthogonal to the conveyance direction, of the certain individual connecting channel 143*a* among the plurality of individual connecting channels 143*a* to be smaller as the certain individual connecting channel 143*a* is located more closely to the right side in the width direction (to the side of the individual channel row 107A). With this, in the plurality of individual connecting channels 143*a*, the channel resistance of the certain individual connecting channel 143*a* among the plurality of individual connecting channel 143*a* becomes greater as the certain individual connecting channel 143*a* is located, in the width direction, more closely to the right side (toward the individual connecting channel row 107A).

The connecting channel 133*b* is provided with respect to the synthetized individual channel row 106B (individual channel rows 107C, 107D). The connecting channel 133*b* has one common connecting channel 141*b*, a plurality of individual connecting channels 142*b*, and a plurality of individual connecting channels 143*b*. The common connecting channel 141*b* is formed in the lower end part of the plate 112, and is located between the common connecting channel 141*a* and the synthetized individual channel row 106B in the conveyance direction. Further, the common connecting channel 141*b* extends in the width direction along the entire length of the synthetized individual channel row 106B. Furthermore, the common connecting channel 141*b* has a length in the conveyance direction which is constant regardless of a position in the width direction, and thus has a cross-sectional area, of a cross section orthogonal to the width direction, which is constant. With this, the common connecting channel 141*b* has channel resistance per unit length which is constant regardless of the position in the width direction. Note that the common connecting channel 141*b* does not have any connecting part with respect to the ink tank 150, unlike the manifolds 136*a* and 137*a* which will be described later on.

The plurality of individual connecting channels 142*b* correspond to the plurality of individual channels 120C, respectively, and are formed in the lower end part of the plate 122. Each of the individual connecting channels 142*b* extends in the conveyance direction and connects a lower end part of one of the descenders 131 of the individual channels 120C with the common connecting channel 141*b*. Further, in the plurality of individual connecting channels 142*b*, a length Lcl2 in the width direction of a certain individual connecting channel 142*b* among the individual connecting channels 142*b* becomes shorter as the certain individual connecting channel 142*b* is located more closely to the left side in the width direction (to the side of the individual channel row 107D), thereby making a cross-sectional area, of a cross section orthogonal to the conveyance direction, of the certain individual connecting channel 142*b* among the plurality of individual connecting channels 142*b* to be smaller as the certain individual connecting channel 142*b* is located more closely to the left side in the width direction (to the side of the individual channel row 107D). With this, in the plurality of individual connecting channels 142*b*, the channel resistance of the certain individual connecting channel 142*b* among the plurality of individual connecting channel 142*b* becomes greater as the certain individual connecting channel 142*b* is located, in the width direction, more closely to the left side (toward the individual connecting channel row 107D).

The plurality of individual connecting channels 143*b* correspond to the plurality of individual channels 120D, respectively, and are formed in the lower end part of the plate 122. Each of the individual connecting channels 143*b* extends in the conveyance direction and connects a lower end part of one of the descenders 131 of the individual channels 120D with the common connecting channel 141*b*. Further, in the plurality of individual connecting channels 143*b*, a length Lc22 in the width direction of a certain individual connecting channel 143*b* among the individual connecting channels 143*b* becomes shorter as the certain individual connecting channel 143*b* is located more closely to the right side in the width direction (to the side of the individual channel row 107C), thereby making a cross-sectional area, of the cross section orthogonal to the conveyance direction, of the certain individual connecting channel 143*b* among the plurality of individual connecting channels 143*b* to be smaller as the certain individual connecting channel 143*b* is located more closely to the right side in the width direction (to the side of the individual channel row 107C). With this, in the plurality of individual connecting channels 143*b*, the channel resistance of the certain individual connecting channel 143*b* among the plurality of individual connecting channel 143*b* becomes greater as the certain individual connecting channel 143*b* is located, in the width direction, more closely to the right side (toward the individual connecting channel row 107C).

The vibration plate 115 is similar to the vibration plate 25, is arranged on the upper surface of the plate 113, and covers the plurality of pressure chambers 130. The plurality of piezoelectric elements 116 correspond to the plurality of pressure chambers 130, respectively. The plurality of piezoelectric elements 116 are similar to the plurality of piezoelectric elements 26; each of the plurality of piezoelectric elements 116 is arranged in a part, of the upper surface of the vibration plate 115, overlapping in the up-down direction with one of the plurality of pressure chambers 130 corresponding thereto.

The protective member 117 is arranged on the upper surface, of the vibration plate 115, on which the plurality of piezoelectric elements 116 are arranged. Two recessed parts 117*a* corresponding to the synthetized individual channel rows 106A and 106B, respectively, are formed in the lower surface of the protective member 117. Each of the two recessed parts 117*a* extends in the width direction; the piezoelectric elements 116 corresponding to the respective synthetized individual channel rows 106A and 106B are accommodated in the inside of the recessed parts 117*a* corresponding to the synthetized individual channel rows 106A and 106B, respectively.

Further, the head unit 100 has two first manifolds 136*a*, 136*b* (corresponding to a "first common channel" of the present disclosure) and two second manifolds 137*a*, 137*b* (corresponding to a "second common channel" of the present disclosure).

The first manifold 136*a* extends, in the up-down direction in a lower part of the protecting member 117, the plate 113 and the vibration plate 115. Further, the first manifold 136*a* is located on the upstream side in the conveyance direction of the individual channel row 107A, and extends in the width direction along the entire length of the individual channel row 107A. Furthermore, ends on the upstream side in the conveyance direction of the plurality of throttles 132 of the plurality of individual channels 120A are connected to the first manifold 136*a*.

The second manifold 137*a* extends, in the up-down direction in the lower part of the protecting member 117, the plate 113 and the vibration plate 115. Further, the second manifold 137*a* is located on the upstream side in the conveyance direction of the individual channel row 107B, and extends in the width direction along the entire length of the individual channel row 107B. Furthermore, ends on the upstream side in the conveyance direction of the plurality of throttles 132 of the plurality of individual channels 120B are connected to the second manifold 137*a*.

Further, a connecting channel 135*a* extending in the width direction and connecting the first manifold 136*a* and the second manifold 137*a* is arranged in parts, of the plate 113 and the vibration plate 115, respectively, which are arranged between the first and second manifolds 136*a* and 137*a* in the width direction. The connecting channel 135*a* has a length in the conveyance direction which is shorter than those of the first and second manifolds 136*a* and 137*a*, and thus has a small cross-sectional area of a cross section orthogonal to the width direction. With this, the connecting channel 135*a* has channel resistance per unit length which is greater than that of each of the first and second manifolds 136*a* and 137*a*.

The first manifold 136*b* extends, in the up-down direction in the lower part of the protecting member 117, the plate 113 and the vibration plate 115. Further, the first manifold 136*b* is located on the downstream side in the conveyance direction of the individual channel row 107C, and extends in the width direction along the entire length of the individual channel row 107C. Furthermore, ends on the downstream side in the conveyance direction of the plurality of throttles 132 of the plurality of individual channels 120C are connected to the first manifold 136*b*.

The second manifold 137*b* extends, in the up-down direction in the lower part of the protecting member 117, the plate 113 and the vibration plate 115. Further, the second manifold 137*b* is located on the downstream side in the conveyance direction of the individual channel row 107D, and extends in the width direction along the entire length of the individual channel row 107D. Furthermore, ends on the downstream side in the conveyance direction of the plurality of throttles 132 of the plurality of individual channels 120D are connected to the second manifold 137*b*.

Further, a connecting channel 135*b* extending in the width direction and connecting the first manifold 136*b* and the second manifold 137*b* is arranged in parts, of the plate 113 and the vibration plate 115, respectively, which are arranged between the first and second manifolds 136*b* and 137*b* in the width direction. The connecting channel 135*b* has a length in the conveyance direction which is shorter than those of the first and second manifolds 136*b* and 137*b*, and thus has a small cross-sectional area of a cross section orthogonal to the width direction. With this, the connecting channel 135*b* has channel resistance per unit length which is greater than that of each of the first and second manifolds 136*b* and 137*b*.

Furthermore, as depicted in FIGS. 4 and 5, a supply channel 138*a* which is connected to the first manifold 136*a* is formed in an upper part of the protecting member 117, at a location overlapping, in the up-down direction, with a right end part in the width direction of the first manifold 136*a*. Further, the supply channel 138*a* is connected to an ink tank 150 (corresponding to a "liquid supply source" of the present disclosure) via a non-depicted channel which is provided with a pump 151*a* at an intermediate part thereof. The pump 151*a* feds the ink from the ink tank 150 toward the supply channel 138*a*.

Furthermore, a supply channel 138*b* which is connected to the first manifold 136*b* is formed in the upper part of the protecting member 117, at a location overlapping, in the up-down direction, with a right end part in the width direction of the first manifold 136*b*. Further, the supply channel 138*b* is connected to the ink tank 150 via a non-depicted channel which is provided with a pump 151*b* at an intermediate part thereof. The pump 151*b* feds the ink from the ink tank 150 toward the supply channel 138*b*.

Note that in the second embodiment, connecting parts of the first manifolds 136*a* and 136*b* at which the first manifolds 136*a* and 136*b* are connected to the supply channels 138*a* and 138*b*, respectively, correspond to a "first connecting part" of the present disclosure.

Further, as depicted in FIGS. 4 and 6, a discharge channel 139*a* is formed in the upper part of the protecting member 117, at a location overlapping, in the up-down direction, with a left end part in the width direction of the second manifold 137*a*. The discharge channel 139*a* is connected to the second manifold 137*a* at an lower end part of the discharge channel 139*a*. Further, an upper end part of the discharge channel 139*a* is connected to the ink tank 150 via a non-depicted channel. A pump 152*a* is provided in a channel between the discharge channel 139*a* and the ink tank 150. The pump 152*a* feds the ink from the discharge channel 139*a* toward the ink tank 150.

Furthermore, a discharge channel 139*b* is formed in the upper part of the protecting member 117, at a location overlapping, in the up-down direction, with a left end part in the width direction of the second manifold 137*b*. The discharge channel 139*b* is connected to the second manifold 137*b* at an lower end part of the discharge channel 139*b*. Further, an upper end part of the discharge channel 139*b* is connected to the ink tank 150 via a non-depicted channel. A pump 152*b* is provided on in a channel between the discharge channel 139*b* and the ink tank 150. The pump 152*b* feds the ink from the discharge channel 139*b* toward the ink tank 150.

Note that in the second embodiment, connecting parts of the second manifolds 137*a* and 137*b* at which the second manifolds 137*a* and 137*b* are connected to the discharge channels 139*a* and 139*b*, respectively, correspond to a "second connecting part" of the present disclosure.

Further, in a case that the pumps 151*a*, 151*b*, 152*a* and 152*b* are driven, the ink inside the ink tank 150 is allowed to flow into the first manifolds 136*a* and 136*b* via the supply channels 138*a* and 138*b*, respectively. The ink inside the first manifolds 136*a* and 136*b* flows mainly from the plurality of throttles 132 into the plurality of individual channels 120A and 120C, respectively. Further, a part of the ink inside the first manifolds 136*a* and 136*b* flows into the second manifolds 137*a* and 137*b* via the connecting channels 135*a* and 135*b*, respectively.

The ink inside the plurality of individual channels 120A and the plurality of individual channels 120C flows, via the plurality of individual connecting channels 142*a* and the plurality of individual connecting channels 142*b*, into the common connecting channels 141*a* and 141*b*, respectively, and further flows into the plurality of individual channels 120B and the plurality of individual channels 120D via the plurality of individual connecting channels 143*a* and the plurality of individual connecting channels 143*b*, respectively. The ink inside the plurality of individual channels 120B and the plurality of individual channels 120D flows from the plurality of throttles 132 and into the second manifolds 137*a* and 137*b*, respectively. The ink inside the second manifolds 137*a* and 137*b* is discharged from the discharge channels 139*a* and 139*b*, respectively, and returns to the ink tank 150. With this, the ink is circulated between the head unit 100 and the ink tank 150.

Note that in the second embodiment, it is allowable that the supply channels 138*a* and 138*b* and the discharge channels 139*a* and 139*b* are connected to the one tank 150. The present disclosure, however, is not limited to this configuration. It is allowable that an ink tank connected to the supply channel 138*a* and the discharge channel 139*a* is provided separately from an ink tank connected to the supply channel 138*b* and the discharge channel 139*b*. Alternatively, it is allowable that only one of the pumps 151*a* and 152*a* is provided, or that only one of the pumps 151*b* and 152*b* is provided. In such a case also, it is possible to circulate the ink in a similar manner as described above.

<Effects>

In the second embodiment, the common connecting channel 141*a*, which is common to the plurality of individual connecting channels 142*a* provided individually with respect to the plurality of individual channels 120A, respectively, and the plurality of individual connecting channel 143*a* provided individually with respect to the plurality of individual channels 120C, respectively, is provided between the plurality of individual connecting channels 142*a* and the plurality of individual connecting channels 143*a*. With this, the channel resistance of the connecting channel 133*a* connecting the plurality of individual channels 120A and the plurality of individual channels 120C is made to be small, thereby making it possible to cause the ink to flow sufficiently between the plurality of individual channels 120A and the plurality of individual channels 120C via the connecting channel 133*a*. Further, since the channel resistance of the connecting channel 133*a* is small, the ink flows easily from the connecting channel 133*a* into the descenders 131 of the individual channels 120A, while avoiding such a situation that the ink leaks from the nozzles 110.

Similarly, the common connecting channel 141*b*, which is common to the plurality of individual connecting channels 142*b* provided individually with respect to the plurality of individual channels 120B, respectively, and the plurality of individual connecting channel 143*b* provided individually with respect to the plurality of individual channels 120D, respectively, is provided between the plurality of individual connecting channels 142*b* and the plurality of individual connecting channels 143*b*. With this, the channel resistance of the connecting channel 133*b* connecting the plurality of individual channels 120B and the plurality of individual channels 120D is made to be small, thereby making it possible to cause the ink to flow sufficiently between the plurality of individual channels 120B and the plurality of individual channels 120D via the connecting channel 133*b*. Further, since the channel resistance of the connecting channel 133*b* is small, the ink flows easily from the connecting channel 133*b* into the descenders 131 of the individual channels 120B, while avoiding such a situation that the ink leaks from the nozzles 110.

Further, in the second embodiment, with respect to such a configuration that the individual channel row 107A and the individual channel row 107B are arranged side by side in the width direction so as to form one synthetized individual channel row 106A, the connecting channel 133*a* which includes the common connecting channel 141*a* which extends in the width direction and of which volume is relatively large can be arranged along the entire length of the synthetized individual channel row 106A. Similarly, with respect to such a configuration that the individual channel row 107C and the individual channel row 107D are arranged side by side in the width direction so as to form one synthetized individual channel row 106B, the connecting channel 133*b* which includes the common connecting channel 141*b* which extends in the width direction and of which volume is relatively large can be arranged along the entire length of the synthetized individual channel row 106B.

Here, there is considered such a case that, unlike the second embodiment, the channel resistance is uniform in all the individual connecting channels 142*a*, that the channel resistance is uniform in all the individual connecting channels 143*a*, and that the channel resistance per unit length is constant in the common connecting channel 141*a* regardless of the position in the width direction. In such a case, when the ink flows between the plurality of individual channels 120A and the plurality of individual channel 120B via the connecting channel 133*a*, the ink is less likely to easily flow to an individual channel 120A which is included in the plurality of individual channels 120A and which is located on the right side, far from the individual channel row 107B, and to an individual channel 120B which is included in the plurality of individual channels 120B and which is located on the left side, far from the individual channel row 107A.

Further, there is considered such a case that, unlike the second embodiment, the channel resistance is uniform in all the individual connecting channels 142*b*; that the channel resistance is uniform in all the individual connecting channels 143*b*; and that the channel resistance per unit length is constant in the common connecting channel 141*b* regardless of the position in the width direction. In such a case, when the ink flows between the plurality of individual channels 120C and the plurality of individual channel 120D via the connecting channel 133*b*, the ink is less likely to easily flow to an individual channel 120C which is included in the plurality of individual channels 120C and which is located on the right side, far from the individual channel row 107D, and to an individual channel 120D which is included in the plurality of individual channels 120D and which is located on the left side, far from the individual channel row 107C.

Furthermore, in these cases, the pressure drop gradient in the ink in the common connecting channels 133*a* and 133*b* becomes great. In the connecting channels 133*a* and 133*b*, paths in which the ink flows in the individual channels 120A and 120B of the individual channel rows 107A and 107B on the upstream side in the conveyance direction, respectively, and paths in which the ink flows in the individual channels 120C and 120D of the individual channel rows 107CB and 107D on the downstream side in the conveyance direction, respectively are long. Therefore, in a case that the above-described pressure drop gradient is great, there is such a fear that the meniscus of the ink is destroyed in the nozzles 110 of the individual channels 120A to 120D.

In the second embodiment, the channel resistance per unit length is constant in the common connecting channel 141*a* regardless of the position in the width direction. In contrast, the channel resistance of a certain individual channel 120A among the plurality of individual channels 120A becomes greater as the certain individual channel 120A is located, in the width direction, more closely to the individual connecting channel row 107B; and the channel resistance of a certain individual channel 120B among the plurality of individual channels 120B becomes greater as the certain individual channel 120B is located, in the width direction, more closely to the individual connecting channel row 107A. With this, as a certain individual channel 120A among the plurality of individual channels 120A is located, in the width direction, more remotely from the individual connecting channel row 107B, the ink flows more easily from the certain individual channel 120A into the common connecting channel 141*a*; and as the certain individual channel 120B among the plurality of individual channels 120B is located, in the width direction, more remotely to the individual connecting channel row 107A, the ink flows more easily into the certain individual channel 120B from the common connecting channel 141*a*. As a result, it is possible to allow the ink to flow uniformly in the plurality of individual channels 120A and 120B.

Furthermore, in the second embodiment, the channel resistance per unit length is constant in the common connecting channel 141*b* regardless of the position in the width direction. In contrast, the channel resistance of a certain individual channel 120C among the plurality of individual channels 120C becomes greater as the certain individual channel 120C is located, in the width direction, more closely to the individual connecting channel row 107D; and the channel resistance of a certain individual channel 120D among the plurality of individual channels 120D becomes greater as the certain individual channel 120D is located, in the width direction, more closely to the individual connecting channel row 107C. With this, it is possible to allow the ink to flow uniformly in the plurality of individual channels 120C and 120D, in a similar manner as that described above regarding the plurality of individual channels 120A and 120B.

Moreover, in a case that the connecting channels 133*a* and 133*b* are configured as described above, it is possible make the pressure drop gradient of the ink to be small in the connecting channels 133*a* and 133*b*. With this, it is possible to prevent the meniscus of the ink from being destroyed in the nozzles 110 of the individual channels 120A and 120B on the upstream side in the conveyance direction in the individual channel rows 107A and 107B, respectively, and to prevent the meniscus of the ink from being destroyed in the nozzles 110 of the individual channels 120C and 120D on the downstream side in the conveyance direction in the individual channel rows 107C and 107D, respectively.

Further, in the second embodiment, the channel resistance per unit length is constant in each of the common connecting channels 141*a* and 141*b* regardless of the position in the width direction, as described above. With this, it is possible to make the configuration of each of the common connecting channels 141*a* and 141*b* to be simple.

Furthermore, in the second embodiment, the spacing distance J between a leftmost nozzle 110 of the individual channel 120A located on the leftmost side in the width direction among the plurality of individual channels 120A and a rightmost nozzle 110 of the individual channel 120A located on the rightmost side in the width direction among the plurality of individual channels 120B is greater than the spacing distance K between the nozzles 110 in each of the plurality of individual channels 120A and the plurality of individual channels 120B, as described above. Similarly, the spacing distance J between a leftmost nozzle 110 of the individual channel 120C located on the leftmost side in the width direction among the plurality of individual channels 120C and a rightmost nozzle 110 of the individual channel 120D located on the rightmost side in the width direction among the plurality of individual channels 120D is greater than the spacing distance K between the nozzles 110 in each of the plurality of individual channels 120C and the plurality of individual channels 120D, as described above.

With respect to this configuration, the second embodiment makes the position in the width direction of the area 105A between the individual channel row 107A and the individual channel row 107B in the synthetized individual channel row 106A to be different from the position in the width direction of the area 105B between the individual channel row 107C and the individual channel row 107D in the synthetized individual channel row 106B. With this, the nozzles 110 of the individual channels 120C are arranged at the position in the width direction of the area 105A in which the nozzles 110 of the individual channels 120A and the nozzles 110 of the individual channels 120B are not arranged; and the nozzles 110 of the individual channels 120B are located at the position of the area 105B in which the nozzles 110 of the individual channels 120C and the nozzles 110 of the individual channels 120D are not arranged. As a result, the nozzles 110 can be arranged, at any position in the width direction, with a density which is not less than that in each of the nozzle rows 109A to 110D.

Note that in such a case, unlike the second embodiment, that the area 105A and the area 105B overlap with each other in the conveyance direction and that an image is recorded by the printer on a recording paper sheet P, then any dots are not formed in a part, of the recording paper sheet P, corresponding to the areas 105A and 105B, and a white streak is formed in the recorded image. Even though the lengths in the width direction of the areas 105A and 105B are short, the white streak is conspicuous even if the length in the width direction of the white streak is short.

In the case of the second embodiment, in an area in which the individual channel row 107A and the individual channel row 107C overlap with each other in the conveyance direction, the nozzles 110 of the individual channel row 107A and the nozzles 110 of the individual channel rows 107C are arranged in the width direction alternately at a spacing distance K/2 which is half the spacing distance K between the nozzles 110 in each of the individual channel rows 107A and 107B. Similarly, in an area in which the individual channel row 107B and the individual channel row 107D overlap with each other in the conveyance direction, the nozzles 110 of the individual channel row 107B and the nozzles 110 of the individual channel rows 107D are arranged in the width direction alternately at a spacing distance K/2 which is half the spacing distance K between the nozzles 110 in each of the individual channel rows 107C and 107D.

With respect to this configuration, in the conveyance direction, in the area between the individual channel rows 107A and 107C, only the nozzles 110 of the individual channel 107C are arranged side by side in the width direction at the spacing distance K. Similarly, in the conveyance direction, in the area between the individual channel row 107B and 107D, only the nozzles 110 of the individual channel 107B are arranged side by side in the width direction at the spacing distance K.

Accordingly, in a case that an image is recorded by the printer on a recording paper sheet P, in a part (image part), of the recorded image, corresponding to the area in which the individual channel row 107A and the individual channel row 107C overlap with each other in the conveyance direction and in an image part of the recorded image corresponding the area in which the individual channel row 107B and the individual channel row 107D overlap with each other in the conveyance direction, the dots are arranged side by side in the width direction at the spacing distance K/2. In contrast, in an image part, of the recorded image, corresponding to the area between individual channel row 107A and the individual channel row 107B and in an image part, of the recorded image, corresponding to the area between individual channel row 107C and the individual channel row 107D, the dots are arranged side by side in the width direction at the spacing distance K. Namely, in the recorded image, the parts in which the spacing distance between the dots in the width direction are different are present.

However, the length in the width direction of the image part corresponding to the area between the individual channel row 107A and the individual channel row 107B, and the length in the width direction of the image part corresponding to the area between the individual channel row 107C and the individual channel row 107D are short. Therefore, the influence, caused by the above-described difference in the spacing distance between the dots, on the image quality of the recorded image is small.

Further, in the second embodiment, the first manifold 136*a* and the second manifold 137*a* which are arranged side by side in the width direction are connected to each other via the connecting channel 135*a*. With this, the ink is allowed to flow between the first manifold 136*a* and the second manifold 137*a* via the connecting channel 135*a*, thereby making it possible to prevent the ink from stagnating at a left end part of the first manifold 136*a* and a right end part of the second manifold 137*a*. On the other hand, since the channel resistance per unit length of the connecting channel 135*a* is greater than the channel resistance per unit length of each of the first and second manifolds 136*a* and 137*a*, it is possible to avoid such a situation that the ink flows too much from the first manifold 136*a* to the second manifold 137*a* via the connecting channel 135*a* and that the ink does not flow sufficiently to the individual channels 120A and 120B.

Furthermore, in the second embodiment, the first manifold 136*b* and the second manifold 137*b* which are arranged side by side in the width direction are connected to each other via the connecting channel 135*b*. With this, it is possible to prevent the ink from stagnating at a left end part of the first manifold 136*b* and a right end part of the second manifold 137*b*, in a similar manner as that described above regarding the first manifold 136*a* and the second manifold 137*a*. On the other hand, it is possible to avoid such a situation that the ink flows too much from the first manifold 136*b* to the second manifold 137*b* via the connecting channel 135*b* and that the ink does not flow sufficiently to the individual channels 120C and 120D.

[Modifications]

In the foregoing, the first and second embodiments of the present disclosure have been explained. The present disclosure, however, is not limited to or restricted by the above-described first and second embodiments; a variety of kinds of changes are possible, within the range described in the claims.

In each of the first and second embodiments, the common connecting channel and the plurality of individual connecting channels have the positions in the up-down direction and the lengths in the up-down direction which are same with one another. Further, the ceiling surface of the common connecting channel and the ceiling surfaces of the plurality of individual connecting channels are located on a same plane which is parallel to the width direction and the conveyance direction. The present disclosure, however, is not limited to or restricted by this configuration. For example, it is allowable that the ceiling surface of the common connecting channel and the ceiling surfaces of the plurality of individual connecting channels have positions in the up-down direction which are different from each other.

Figure 7:
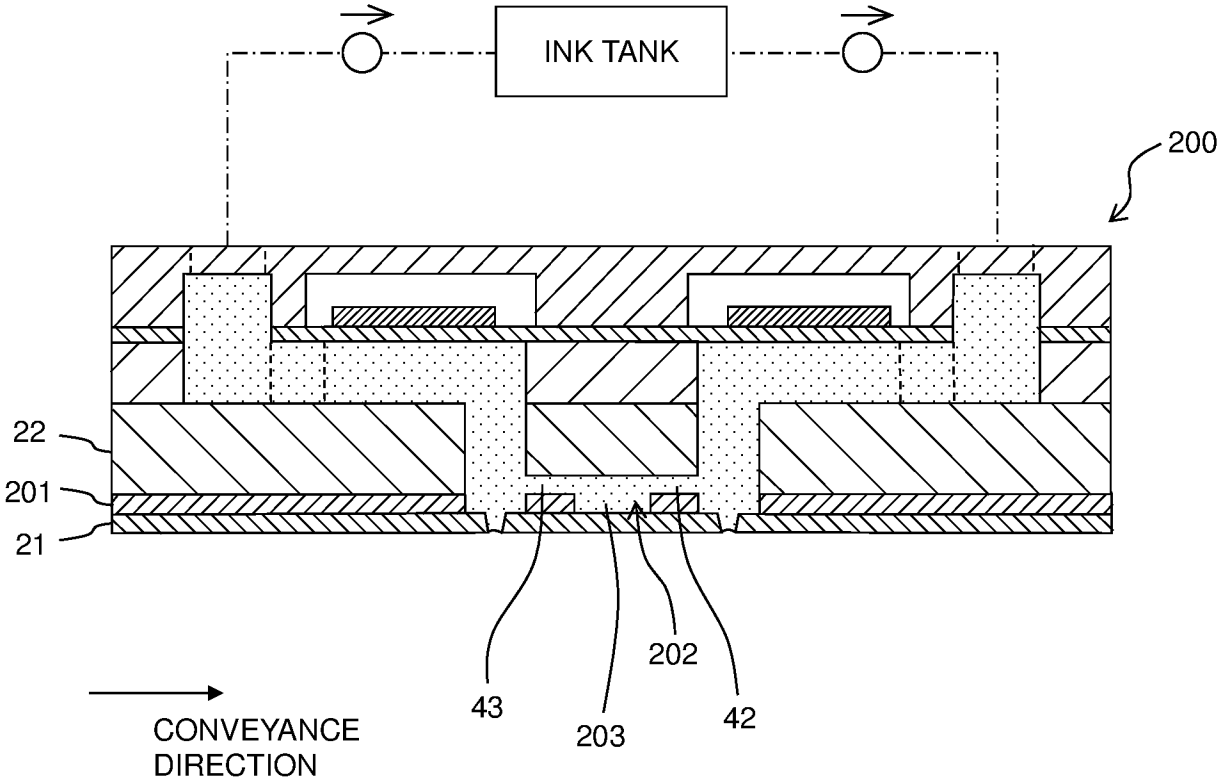
FIG. 7 is a cross-sectional view of a head unit 200, corresponding to FIG. 3.

Alternatively, in a first modification as depicted in FIG. 7, for example, a plate 201 is arranged between a plate 21 and a plate 22 in a head unit 200. Further, in a connecting channel 202 of the head unit 200, a common connecting channel 203 extends in a lower part of the plate 22 and the plate 201, and extends downwardly up to a location below a plurality of individual connecting channels 42 and a plurality of individual connecting channels 43. Further, in the case of the first modification, the common connecting channel 203 is allowed to have a volume greater than that of the common connecting channel 41 in the first embodiment.

Furthermore, also in the second embodiment, it is allowable that another plate is arranged between the plate 111 and the plate 112, and that a common connecting channel is configured to extend up to a location below the plurality of individual connecting channels 142*a*, 142*b*, 143*a* and 143*b*.

Moreover, in the first and second embodiments, although the individual connecting channels are connected to the lower end parts of the descenders, respectively, the present disclosure is not limited to this configuration. The individual connecting channels may be connected to parts, of the descenders, which are different from the lower end parts thereof, respectively.

Figure 8:
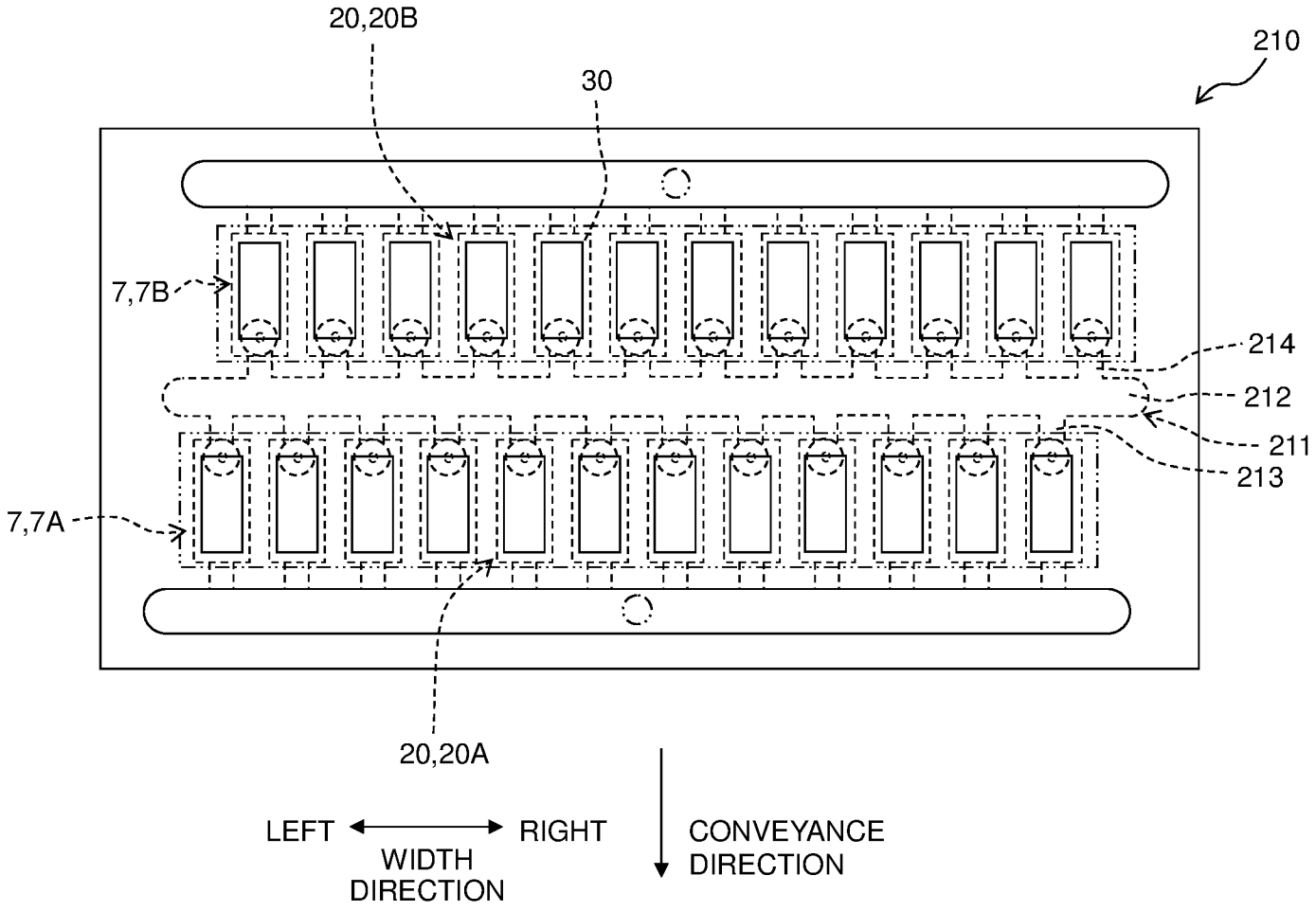
FIG. 8 is a plan view of a head unit 210, corresponding to FIG. 2.
Figure 9:
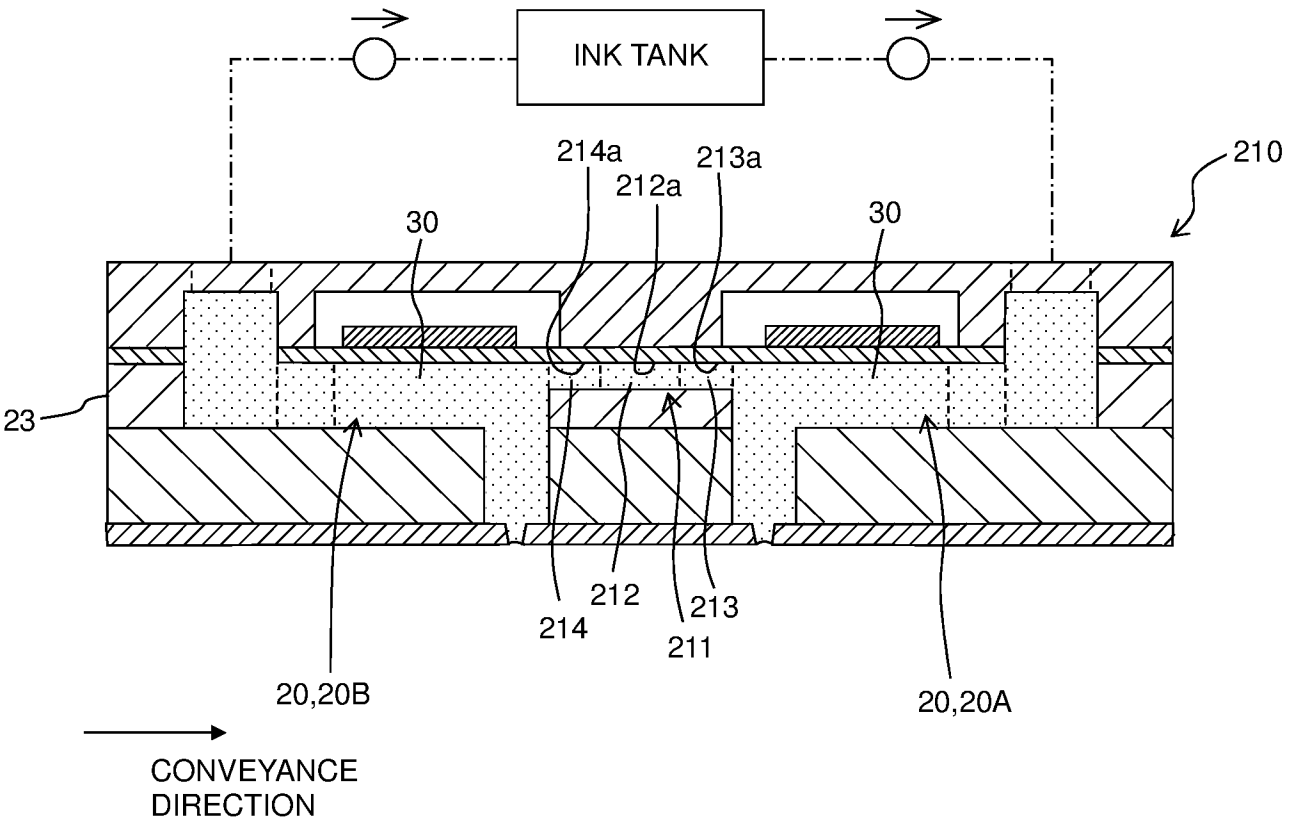
FIG. 9 is a cross-sectional view of the head unit 210, corresponding to FIG. 3.

Further, the individual connecting channels are not limited to being connected to the descenders, respectively. For example, in a head unit 210 of a second modification, a connecting channel 211 has a common connecting channel 212, a plurality of individual connecting channels 213 and a plurality of individual connecting channel 214, as depicted in FIGS. 8 and 9.

The common connecting channel 212 is formed in an upper part of the plate 23, and at a location which is positioned between the plurality of individual connecting channels 7A and the plurality of individual connecting channels 7B in the conveyance direction. Further, the common connecting channel 212 extends in the width direction along the entire lengths of the individual channel rows 7A and 7B.

The plurality of individual connecting channels 213 correspond to the plurality of individual channels 20A, respectively, and are formed in the upper part of the plate 23. The plurality of individual connecting channels 213 are arranged, in the conveyance direction, between the plurality of individual channels 20A and the common connecting channel 212, extend in the conveyance direction and connect a plurality of pressure chambers 30 of the plurality of individual channels 20A to the common connecting channel 212.

The plurality of individual connecting channels 214 correspond to the plurality of individual channels 20B, respectively, and are formed in the upper part of the plate 23. The plurality of individual connecting channels 214 are arranged, in the conveyance direction, between the plurality of individual channels 20B and the common connecting channel 212, extend in the conveyance direction and connect a plurality of pressure chambers 30 of the plurality of individual channels 20B to the common connecting channel 212.

Further, the common connecting channel 212 and the plurality of individual connecting channels 213 and the plurality of individual connecting channels 214 have the positions in the up-down direction and the lengths in the up-down direction which are same to one another. With this, a ceiling surface 212*a* of the common connecting channel 212, a ceiling surface 213*a* of each of the plurality of individual connecting channels 213 and a ceiling surface 214*a* of each of the plurality of individual connecting channels 43 are located on a same plane which is parallel to the width direction and the conveyance direction.

Furthermore, in the second modification, the ink inside the plurality of pressure chambers 30 constructing the plurality of individual channels 20A, respectively, flows to the common connecting channel 212 via the plurality of individual connecting channels 213, and further flows to the plurality of pressure chambers 30 of the plurality of individual connecting channels 20B via the plurality of individual connecting channels 214, respectively. Moreover, in this case, any air bubble flowing into the pressure chamber 30 of a certain individual channel 20A among the plurality of individual channels 20A flows into the pressure chamber 30 of the individual channel 20B which is included in the plurality of individual channels 20B, and which corresponds to the certain individual channel 20A, via the individual connecting channel 213, the common connecting chamber 212 and the individual connecting channel 214. With this, it is possible to sufficiently discharge the air bubble inside the pressure chamber 30 therefrom.

Further, also in the second embodiment, it is allowable to form connecting channels connecting the pressure chambers 130 of the individual channels 120A to the pressure chambers 130 of the individual channels 120B, respectively, at an upper part of the plate 113, and to form connecting channels connecting the pressure chambers 130 of the individual channels 120C to the pressure chambers 130 of the individual channels 120D, respectively, at the upper part of the plate 113, similarly to the second modification.

Figure 10:
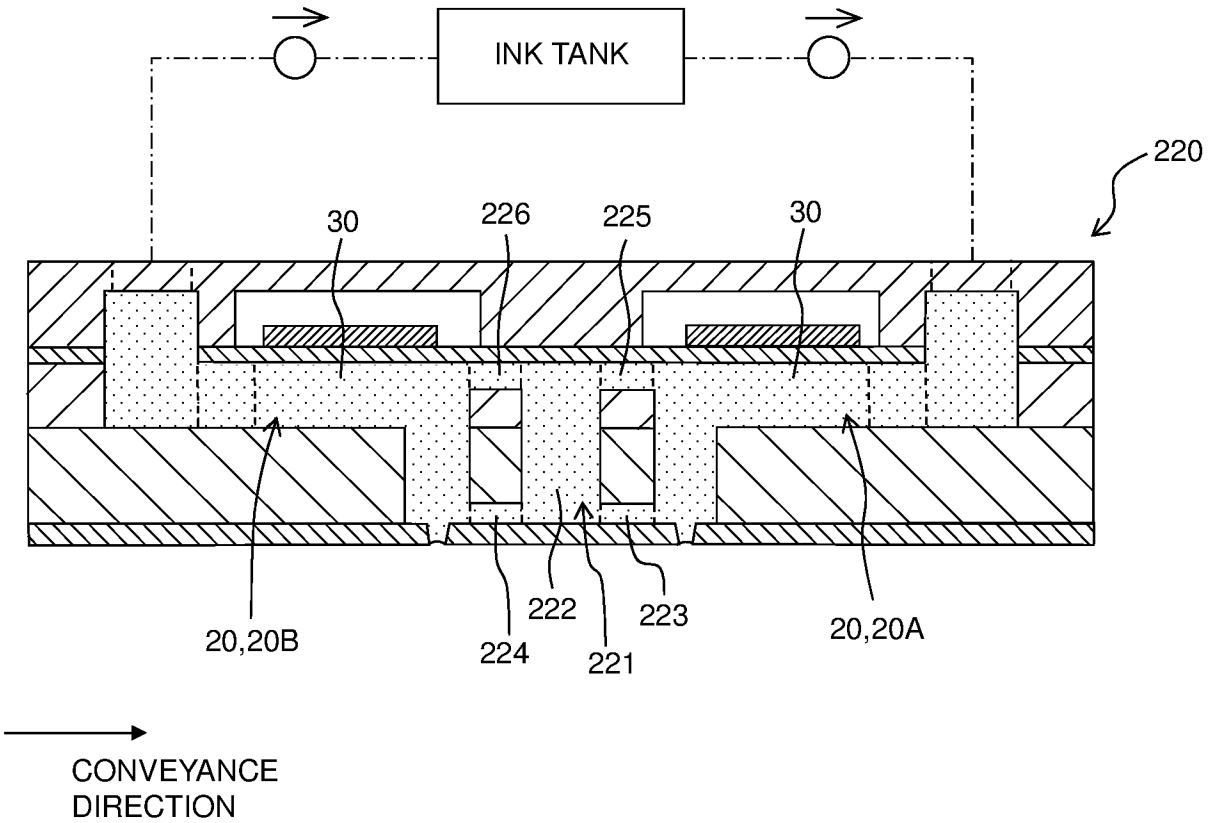
FIG. 10 is a cross-sectional view of a head unit 220, corresponding to FIG. 3.

Furthermore, each of the individual channels is not limited to being connected to the connecting channel only at one position (location). For example, in a thirdmodification as depicted in FIG. 10, a head unit 220 has a configuration wherein the connecting channel 33 of the head unit 11 in the first embodiment is replaced by a connecting channel 221.

The connecting channel 221 has a common connecting channel 222, and pluralities of individual connecting channels 223 to 226. The common connecting channel 222 extends in the plates 22 and 23 in the up-down direction. Further, the common connecting channel 222 extends in the width direction along the entire lengths of the individual channel rows 7A and 7B.

The plurality of individual connecting channels 223 are similar to the plurality of individual connecting channels 42 of the first embodiment; each of the plurality of individual connecting channels 223 extends in the conveyance direction and connects a lower end part of the descender 31 of one of the individual channels 20A to a lower end part of the common connecting channel 222. The plurality of individual connecting channels 224 are similar to the plurality of individual connecting channels 43 of the first embodiment; each of the plurality of individual connecting channels 224 extends in the conveyance direction and connect a lower end part of the descender 31 of one of the individual channels 20B to the lower end part of the common connecting channel 222.

The plurality of individual connecting channels 225 are similar to the plurality of individual connecting channels 213 of the second modification; each of the plurality of individual connecting channels 225 extends in the conveyance direction and connects the pressure chamber 30 of one of the individual channels 20A to an upper end part of the common connecting channel 222. The plurality of individual connecting channels 226 are similar to the plurality of individual connecting channels 214 of the second modification; each of the plurality of individual connecting channels 226 extends in the conveyance direction and connects the pressure chamber 30 of one of the individual channels 20B to the upper end part of the common connecting channel 222.

Further, in the third modification, the ink is allowed to flow between the descenders 31 and the pressure chambers 30 of the plurality of individual channels 20A and the descenders 31 and the pressure chambers 30 of the plurality of individual channels 20B, via the connecting channel 221. Furthermore, in this case, both of any air bubbles accumulated in the pressure chamber(s) 30 and any air bubbles flowing into the nozzle(s) 10 can be discharged efficiently. Moreover, it is possible to suppress any drying of the ink inside the nozzles 10.

Figure 11:
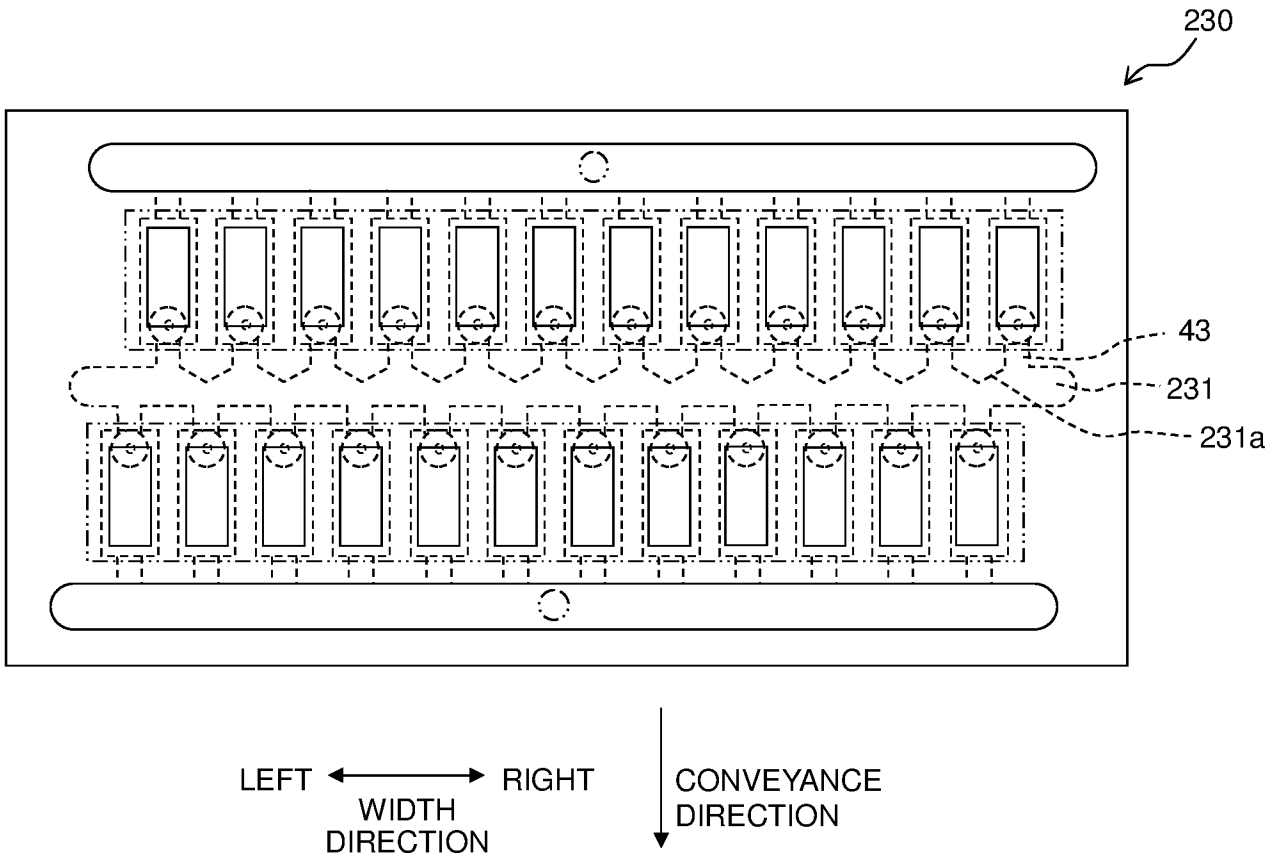
FIG. 11 is a plan view of a head unit 230, corresponding to FIG. 2.

Further, an inner wall surface of the common connecting channel may be configured so as to allow any air bubble(s) inside the common connecting channel to flow out therefrom easily. For example, in a fourth modification as depicted in FIG. 11, a head unit 230 has a configuration wherein the connecting channel 41 of the head unit 11 is replaced by a connecting channel 231. In the common connecting channel 231, a plurality of individual connecting channels 43 are connected to an inner wall surface 231*a* on the upstream side in the conveyance direction of the common connecting channel 231. Furthermore, a plurality of parts, of the inner wall surface 231*a*, located between two individual connecting channels 43 which are included in the plurality of individual connecting channels 43 and which are adjacent to each other in the width direction, extend while being inclined with respect to the width direction so that each of the plurality of parts approaches in the width direction further toward the upstream side in the conveyance direction (toward the outside of the common connecting channel 41 in the conveyance direction), as each of the parts approaches more closely in the width direction to the two second individual connecting channels 43.

In this case, any air bubble reaching the inner wall surface 231*a*, of the common connecting channel 231, in which each of the plurality of individual connecting channels 43 is open, is guided smoothly to each of the plurality of individual connecting channels 43 along the inner wall surface 231*a*. With this, it is possible to allow the air bubble to flow smoothly from the common connecting channel 231 to each of the plurality of individual connecting channels 43.

Figure 12:
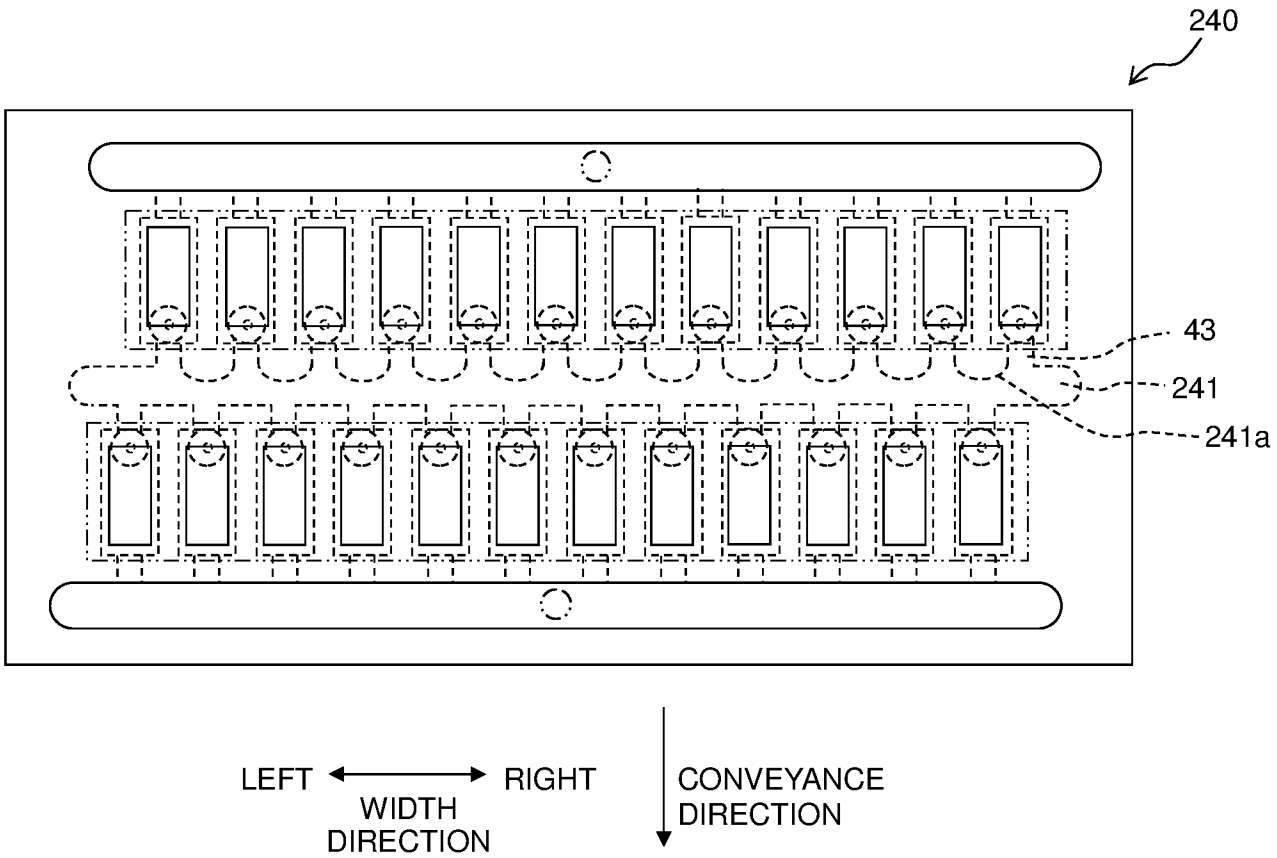
FIG. 12 is a plan view of a head unit 240, corresponding to FIG. 2.

Alternatively, for example in a fifth modification as depicted in FIG. 12, a head unit 240 has a configuration wherein the common connecting channel 41 in the head unit 11 is replaced by a common connecting channel 241. In the common connecting channel 241, a plurality of individual connecting channels 43 are connected to an inner wall surface 241*a* on the upstream side in the conveyance direction of the common connecting channel 241. Further, in the inner wall surface 241*a*, a plurality of parts, of the inner wall surface 241*a*, located between two individual connecting channels 43 which are included in the plurality of individual connecting channels 43 and which are adjacent to each other in the width direction, are curved so that each of the plurality of parts projects toward the inner side in the conveyance direction of the common connecting channel 241.

In this case, any air bubble reaching the inner wall surface 241*a*, of the common connecting channel 241, in which each of the plurality of individual connecting channels 43 is open, is guided smoothly to each of the plurality of individual connecting channels 43 along the inner wall surface 241*a*. With this, it is possible to allow the air bubble to flow smoothly from the common connecting channel 241 to each of the plurality of individual connecting channels 43.

Further, in the second embodiment, it is allowable that a plurality of parts, of an inner wall surface on the upstream side in the conveyance direction of the common connecting channel 141*a*, located between two individual connecting channels 143*a* which are included in the plurality of individual connecting channels 143*a* and which are adjacent to each other in the width direction, and/or a plurality of parts, of an inner wall surface on the downstream side in the conveyance direction of the common connecting channel 141*b*, located between two individual connecting channels 143*b* which are included in the plurality of individual connecting channels 143*b* and which are adjacent to each other in the width direction, is/are configured to be inclined or curved surfaces with respect to the width direction, in a similar manner as in the third and fourth modifications.

Furthermore, in the second embodiment, the common connecting channel 141*a* has the channel resistance per unit length which is constant regardless of the position in the width direction; in the plurality of individual connecting channels 142*a*, the channel resistance of the certain individual connecting channel 142*a* among the plurality of individual connecting channel 142*a* becomes greater as the certain individual connecting channel 142*a* is located, in the width direction, more closely to the individual connecting channel row 107B; and in the plurality of individual connecting channels 143*a*, the channel resistance of the certain individual connecting channel 143*a* among the plurality of individual connecting channel 143*a* becomes greater as the certain individual connecting channel 143*a* is located, in the width direction, more closely to the individual connecting channel row 107A, to thereby allow the ink to flow uniformly in the plurality of individual channels 120A and 120B. Further, the common connecting channel 141*b* has the channel resistance per unit length which is constant regardless of the position in the width direction; in the plurality of individual connecting channels 142*b*, the channel resistance of the certain individual connecting channel 142*b* among the plurality of individual connecting channel 142*b* becomes greater as the certain individual connecting channel 142*b* is located, in the width direction, more closely to the individual connecting channel row 107D; and in the plurality of individual connecting channels 143*b*, the channel resistance of the certain individual connecting channel 143*b* among the plurality of individual connecting channel 143*b* becomes greater as the certain individual connecting channel 143*b* is located, in the width direction, more closely to the individual connecting channel row 107C, to thereby allow the ink to flow uniformly in the plurality of individual channels 120C and 120D. The present disclosure, however, is not limited to this configuration.

Figure 13:
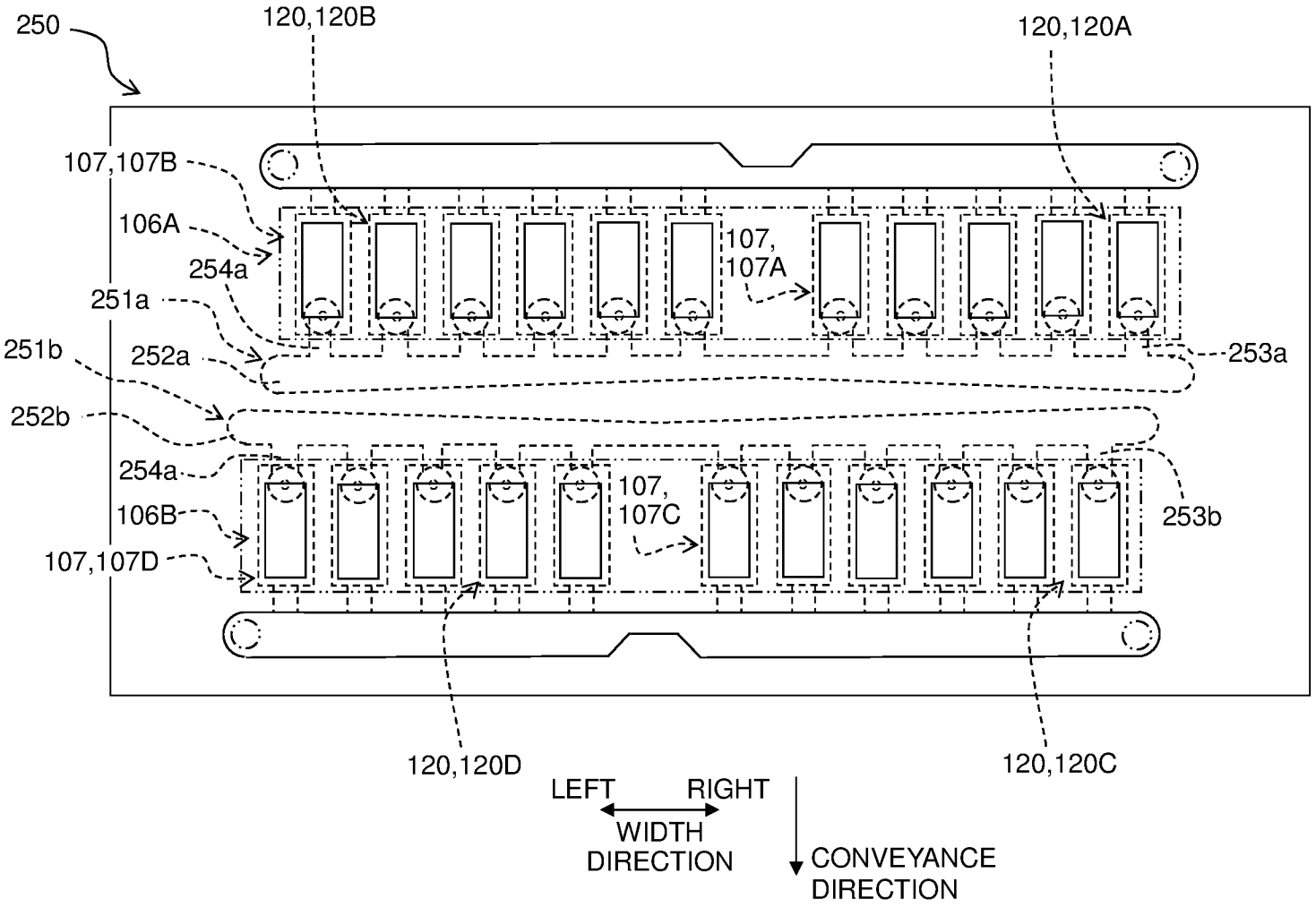
FIG. 13 is a plan view of a head unit 250, corresponding to FIG. 2.

For example, in a sixth modification as depicted in FIG. 13, a head unit 250 has a configuration wherein the connecting channels 133*a* and 133*b* of the head unit 100 in the second embodiment are replaced by connecting channels 251*a* and 252*b*.

The connecting channel 251*a* has a common connecting channel 252*a*, a plurality of individual connecting channels 253*a*, and a plurality of individual connecting channels 254*a*. Although the common connecting channel 252*a* extends in the width direction along the entire length of the synthetized individual channel row 106A (individual channel rows 107A, 107B) similarly to the common connecting channel 141*a*, the common connecting channel 252*a* has such a configuration, unlike the common connecting channel 141*a*, that the length in the conveyance direction becomes shorter, as approaching closely toward the central side in the width direction, thereby making the cross-sectional area of a cross section orthogonal to the width direction to be smaller, as approaching closely toward the central side in the width direction. With this, in the common connecting channel 252*a*, the channel resistance per unit length becomes greater, as approaching closely toward the central side in the width direction. Further, in the common connecting channel 252*a*, the channel resistance per unit length becomes the greatest at a part, in the width direction, which is located between the individual channel row 107A and the individual channel row 107B.

The plurality of individual connecting channels 253*a* correspond to the plurality of individual channels 120A, respectively; each of the plurality of individual connecting channels 253*a* extends in the conveyance direction, and connects the descender 131 of one of the plurality of individual channels 120A to the common connecting channel 252*a*. Further, the plurality of individual connecting channels 253*a* have lengths in the width direction which are all the same. With this, the channel resistances of all the plurality of individual connecting channels 253*a* are substantially same to one another.

The plurality of individual connecting channels 254*a* correspond to the plurality of individual channels 120B, respectively; each of the plurality of individual connecting channels 254*a* extends in the conveyance direction, and connects the descender 131 of one of the plurality of individual channels 120B to the common connecting channel 252*a*. Further, the plurality of individual connecting channels 254*a* have lengths in the width direction which are all the same. With this, the channel resistances of all the plurality of individual connecting channels 254*a* are substantially same to one another.

The connecting channel 251*b* has a common connecting channel 252*b*, a plurality of individual connecting channels 253*b*, and a plurality of individual connecting channels 254*b*. Although the common connecting channel 252*b* extends in the width direction along the entire length of the synthetized individual channel row 106B (individual channel rows 107C, 107D) similarly to the common connecting channel 141*b*, the common connecting channel 252*b* has such a configuration, unlike the common connecting channel 141*b*, that the length in the conveyance direction becomes shorter, as approaching closely toward the central side in the width direction, thereby making the cross-sectional area of a cross section orthogonal to the width direction to be smaller, as approaching closely toward the central side in the width direction. With this, in the common connecting channel 252*b*, the channel resistance per unit length becomes greater, as approaching closely toward the central side in the width direction. Further, in the common connecting channel 252*b*, the channel resistance per unit length becomes the greatest at a part, in the width direction, which is located between the individual channel row 107C and the individual channel row 107D.

The plurality of individual connecting channels 253*b* correspond to the plurality of individual channels 120C, respectively; each of the plurality of individual connecting channels 253*b* extends in the conveyance direction, and connects the descender 131 of one of the plurality of individual channels 120C to the common connecting channel 252*b*. Further, the plurality of individual connecting channels 253*b* have lengths in the width direction which are all the same. With this, the channel resistances of all the plurality of individual connecting channels 253*b* are substantially same to one another.

The plurality of individual connecting channels 254*b* correspond to the plurality of individual channels 120D, respectively; each of the plurality of individual connecting channels 254*b* extends in the conveyance direction, and connects the descender 131 of one of the plurality of individual channels 120D to the common connecting channel 252*b*. Further, the plurality of individual connecting channels 254*b* have lengths in the width direction which are all the same. With this, the channel resistances of all the plurality of individual connecting channels 254*b* are substantially same to one another.

In the sixth modification, the channel resistances in all the plurality of individual connecting channels 253*a* are all the same, and the channel resistances in all the plurality of individual connecting channels 254*a* are all the same. In contrast, in parts, of the common connecting channel 252*a*, which are connected to the plurality of individual connecting channels 253*a*, respectively, the channel resistance per unit length is greater as a part, among the parts, is located more closely to the individual channel row 107B in the width direction. Further, in parts, of the common connecting channel 252*a*, which are connected to the plurality of individual connecting channels 254*a*, respectively, the channel resistance per unit length is greater as a part, among the parts, is located more closely to the individual channel row 107A in the width direction. With this, as a certain individual channel 120A among the plurality of individual channels 120A is located, in the width direction, more remotely from the individual connecting channel row 107B, the ink flows more easily from the certain individual channel 120A into the common connecting channel 252*a*; and as the certain individual channel 120B among the plurality of individual channels 120B is located, in the width direction, more remotely to the individual connecting channel row 107A, the ink flows more easily into the certain individual channel 120B from the common connecting channel 252*a*. As a result, it is possible to allow the ink to flow uniformly in the plurality of individual channels 120A and 120B.

Similarly, the channel resistances in all the plurality of individual connecting channels 253*a* are all the same, and the channel resistances in all the plurality of individual connecting channels 254*b* are all the same. In contrast, in parts, of the common connecting channel 252*b*, which are connected to the plurality of individual connecting channels 253*b*, respectively, the channel resistance per unit length is greater as a part, among the parts, is located more closely to the individual channel row 107D in the width direction. Further, in parts, of the common connecting channel 252*b*, which are connected to the plurality of individual connecting channels 254*b*, respectively, the channel resistance per unit length is greater as a part, among the parts, is located more closely to the individual channel row 107C in the width direction. With this, as a certain individual channel 120C among the plurality of individual channels 120C is located, in the width direction, more remotely from the individual connecting channel row 107D, the ink flows more easily from the certain individual channel 120C into the common connecting channel 252*b*; and as the certain individual channel 120D among the plurality of individual channels 120D is located, in the width direction, more remotely to the individual connecting channel row 107C, the ink flows more easily into the certain individual channel 120D from the common connecting channel 252*b*. As a result, it is possible to allow the ink to flow uniformly in the plurality of individual channels 120C and 120D.

Figure 14:
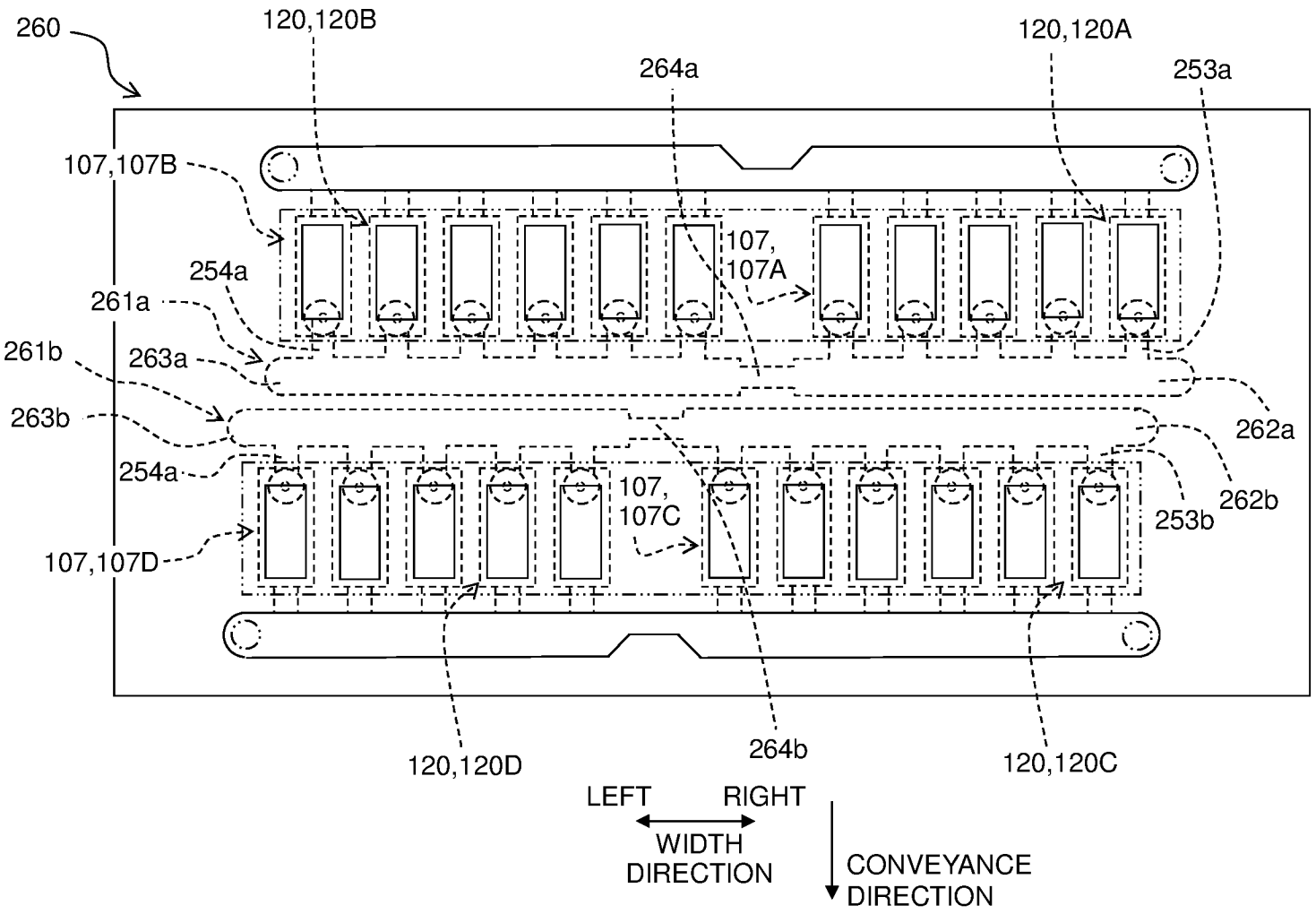
FIG. 14 is a plan view of a head unit 260, corresponding to FIG. 2.

In a seventh modification as depicted in FIG. 14, a head unit 260 has a configuration wherein the common connecting channels 252*a* and 252*b* of the head unit 250 in the sixth embodiment is replaced by common connecting channels 261*a* and 261*b*. The common connecting channel 261*a* has a configuration wherein a length in the conveyance direction which is constant regardless of a position in the width direction at a channel part 262*a* at which the common connecting channel 261*a* is connected to a plurality of individual channels 170A, and at a channel part 263*a* at which the common connecting channel 261*a* is connected to a plurality of individual channels 170B. On the other hand, the common connecting channel 261*a* has a channel part 264*a* which is located between the channel parts 262*a* and 263*a* in the width direction; in the channel part 264*a*, a length in the conveyance direction is made to be smaller than those in the channel parts 262*a* and 263*a*, thereby making a cross-sectional area of a cross section orthogonal to the width direction of the channel part 264*a* to be smaller than those of the channel parts 262*a* and 263*a*. With this, the common connecting channel 261*a* has a channel resistance per unit length which is greater in the channel part 264*a*, than in each of the channel parts 262*a* and 263*a*.

The common connecting channel 261*b* has a configuration wherein a length in the conveyance direction which is constant regardless of a position in the width direction at a channel part 262*b* at which the common connecting channel 261*b* is connected to a plurality of individual channels 170C, and at a channel part 263*b* at which the common connecting channel 261*b* is connected to a plurality of individual channels 170D. On the other hand, the common connecting channel 261*b* has a channel part 264*b* which is located between the channel parts 262*b* and 263*b* in the width direction; in the channel part 264*b*, a length in the conveyance direction is made to be smaller than those in the channel parts 262*b* and 263*b*, thereby making a cross-sectional area of a cross section orthogonal to the width direction of the channel part 264*b* to be smaller than those of the channel parts 262*b* and 263*b*. With this, the common connecting channel 261*b* has a channel resistance per unit length which is greater in the channel part 264*b*, than in each of the channel parts 262*b* and 263*b*.

Further, in the case of the seventh modification, a plurality of parts, in the common connecting channel 261*a*, which communicate the individual connecting channels 142*a* with the individual connecting channels 143*a* each include the channel part 264*a*. Furthermore, the channel part 264*a* is a part at which the channel resistance per unit length is the greatest in the common connecting channel 261*a*. With this, it is possible to reduce the difference to be small in the channel resistance among the plurality of parts which communicate the individual connecting channels 142*a* with the individual connecting channels 143*a*. As a result, it is possible to allow the ink to flow uniformly in the plurality of individual channels 120A and the plurality of individual channels 120B.

Similarly, a plurality of parts, in the common connecting channel 261*b*, which communicate the individual connecting channels 142*b* with the individual connecting channels 143*b* each include the channel part 264*b*. Further, the channel part 264*b* is a part at which the channel resistance per unit length is the greatest in the common connecting channel 261*b*. With this, it is possible to reduce the difference to be small in the channel resistance among the plurality of parts which communicate the individual connecting channels 142*b* with the individual connecting channels 143*b*. As a result, it is possible to allow the ink to flow uniformly in the plurality of individual channels 120C and the plurality of individual channels 120D.

Further, in the second embodiment, the connecting channel may be configured to have: common connecting channels 252*a* and 252*b* which are similar to those in the sixth modification; and a plurality of individual connecting channels 142*a*, a plurality of individual connecting channels 142*b*, a plurality of individual connecting channels 143*a* and a plurality of individual connecting channels 143*b* which are similar to those in the second embodiment. Alternatively, in the second embodiment, the connecting channel may be configured to have: common connecting channels 261*a* and 262*b* which are similar to those in the seventh modification; and a plurality of individual connecting channels 142*a*, a plurality of individual connecting channels 142*b*, a plurality of individual connecting channels 143*a* and a plurality of individual connecting channels 143*b* which are similar to those in the second embodiment.

Furthermore, in the second embodiment, although the first manifold 136*a* and the second manifold 137*a* are connected to each other by the connecting channel 135*a*, and the first manifold 136*b* and the second manifold 137*b* are connected to each other by the connecting channel 135*b*, the present disclosure is not limited to this configuration. It is allowable that the connecting channel 135*a* is omitted (is not provided), and that the first manifold 136*a* and the second manifold 137*a* may be separated (isolated) from each other in the width direction. Moreover, it is allowable that the connecting channel 135*b* is omitted (is not provided), and that the first manifold 136*b* and the second manifold 137*b* may be separated (isolated) from each other in the width direction.

Further, in the second embodiment, although the head unit 100 is provided with the two synthetized individual channel rows 106A and 106B which are arranged side by side in the conveyance direction, the present disclosure is not limited to this configuration. For example, in the second embodiment, the head unit may be provided with three or more synthetized individual channel rows which are arranged side by side in the conveyance direction.

Furthermore, in the second embodiment, the distance J in the width direction between an individual channel 120A, which is included in the plurality of individual channel 120A and which is located most closely to the individual channel row 107B, and an individual channel 120B, which is included in the plurality of individual channel 120B and which is located most closely to the individual channel row 107A is greater than the distance K in the width direction among the plurality of individual channels 120A and the distance K in the width direction among the plurality of individual channels 120B. Moreover, the distance J in the width direction between an individual channel 120C, which is included in the plurality of individual channel 120C and which is located most closely to the individual channel row 107D, and an individual channel 120D, which is included in the plurality of individual channel 120D and which is located most closely to the individual channel row 107C is greater than the distance K in the width direction among the plurality of individual channels 120C and the distance K in the width direction among the plurality of individual channels 120D. The present disclosure, however, is not limited to this configuration. For example, in a case that the first manifold and the second manifold can be arranged to be close to each other in the width direction, the above-described distance K and the above-described distance J may be same. Further, in such a case, the head unit may be provided with only one piece of the synthetized individual channel row.

Further, in the first embodiment, the relationship $|La1-Lb1|=n1\times V\times T$ holds, and the relationship $|La2-Lb2|=n2\times V\times T$ holds. The present disclosure, however, is not limited to this. It is allowable that only one of the two relationships holds. Alternatively, it is allowable that both the two relationships do not hold.

Furthermore, it is allowable that the direction in which the ink is circulated between the head unit and the ink tank is a reverse direction to the above-described direction. For example, in the first embodiment, the directions in which the ink is fed by the pumps 51 and 52, respectively, may all be reversed. Further, in the second embodiment, the directions in which the ink is fed by the pumps 151*a*, 151*b*, 152*a* and 152*b*, respectively, may all be reversed.

Furthermore, the present disclosure is not limited to the configuration wherein the ink is circulated between the head unit and the ink tank. For example, it is allowable that in the first and second embodiments, any pomp is not provided between the head unit and the ink tank. In such a case, accompanying with the discharge of the ink from the nozzles, the ink inside the manifolds flows from the throttles into the individual channels, respectively, and the ink inside the connecting channels flows from descenders into the individual channels, respectively.

Further, although the foregoing explanation has been given about the examples wherein the present disclosure is applied to an ink-jet head (head unit) which discharges the ink from the nozzles, the present disclosure is not limited to this configuration. For example, it is also possible to apply the present disclosure to a liquid discharge head which is configured to discharge, from the nozzle(s), a liquid different from the ink.

What is claimed is:

1. A liquid discharging head comprising:

a first individual channel row including a plurality of first individual channels which are aligned in a first direction and in which a plurality of first nozzles are opened, respectively;

a second individual channel row including a plurality of second individual channels which are aligned in the first direction and in which a plurality of second nozzles are opened, respectively;

a first common channel extending in the first direction, connected to the plurality of first individual channels, and having a first connecting part connectable to a liquid supply source;

a second common channel extending in the first direction, connected to the plurality of second individual channels, and having a second connecting part connectable to the liquid supply source; and a connecting channel arranged side by side with respect to the first and second individual channel rows in a second direction orthogonal to the first direction, and connecting the plurality of first individual channels and the plurality of second individual channels to one another, the connecting channel including:

a common connecting channel which does not have a connecting part with respect to the liquid supply source and which is communicated with the plurality of first individual channels and the plurality of second individual channels;

a plurality of first individual connecting channels which correspond to the plurality of first individual channels, respectively, and each of which connects one of the plurality of first individual channels to the common connecting channel; and a plurality of second individual connecting channels which correspond to the plurality of second individual channels, respectively, and each of which connects one of the plurality of second individual channels to the common connecting channel.

2. The liquid discharge head according to claim 1, wherein the plurality of first individual channels include, respectively:

a plurality of first pressure chambers overlapping with the plurality of first nozzles, respectively, in a third direction orthogonal to both of the first and second directions; and a plurality of first descenders extending in the third direction and connecting the plurality of first nozzles to the plurality of first pressure chambers, respectively, wherein the plurality of second individual channels include, respectively:

a plurality of second pressure chambers overlapping with the plurality of second nozzles in the third direction, respectively; and a plurality of second descenders extending in the third direction and connecting the plurality of second nozzles to the plurality of second pressure chambers, respectively, wherein the plurality of first individual connecting channels are connected to the plurality of first descenders, respectively, and wherein the plurality of second individual connecting channels are connected to the plurality of second descenders, respectively.

3. The liquid discharge head according to claim 2, wherein the first common channel is a channel via which a liquid is allowed to flow into the plurality of first individual channels, wherein the second common channel is a channel to which a liquid is allowed to flow from the plurality of second individual channels, wherein the plurality of first individual connecting channels are connected to end parts of the plurality of first descenders, respectively, the end parts being on a side of the plurality of first nozzles in the third direction, wherein the plurality of second individual connecting channels are connected to end parts of the plurality of second descenders, respectively, the end parts being on a side of the plurality of second nozzles in the third direction, and wherein positions in the third direction and lengths in the third direction are same among the plurality of first individual connecting channels, the plurality of second individual connecting channels and the common connecting channel.

4. The liquid discharge head according to claim 2, wherein in the third direction, the common connecting channel extends more closely to a side of the plurality of first nozzles than the plurality of first individual connecting channels, and extends more closely to a side of the plurality of second nozzles than the plurality of second individual connecting channels.

5. The liquid discharge head according to claim 2, wherein a relationship $|La-Lb|=n\times V\times T$ holds, and in the relationship:

La is a length in the third direction between a connecting part, of each of the plurality of first descenders, at which each of the plurality of first descenders is connected to one of the plurality of first individual connecting channels, and one of the plurality of first nozzles, Lb is a length in the second direction of each of the plurality of first individual connecting channels, V is velocity of propagation of pressure wave in a liquid, T is a period of the pressure wave, and n is a natural number.

6. The liquid discharge head according to claim 1, wherein the plurality of first individual channels include a plurality of first pressure chambers communicated with the plurality of first nozzles, respectively, wherein the plurality of second individual channels include a plurality of second pressure chambers communicated with the plurality of second nozzles, respectively, wherein the plurality of first individual connecting channels are connected to the plurality of first pressure chambers, respectively, and wherein the plurality of second individual connecting channels are connected to the plurality of second pressure chambers, respectively.

7. The liquid discharge head according to claim 2, wherein each of the first and second directions is a horizontal direction, wherein the third direction is a vertical direction, and wherein ceiling surfaces of the plurality of individual connecting channels, ceiling surfaces of the second individual connecting channel and a ceiling surface of the common connecting channel are located on a same plane.

8. The liquid discharge head according to claim 1, wherein the plurality of first individual channels include, respectively:

a plurality of first pressure chambers overlapping with the plurality of first nozzles, respectively, in a third direction orthogonal to both of the first and second directions; and a plurality of first descenders extending in the third direction and connecting the plurality of first nozzles to the plurality of first pressure chambers, respectively, wherein the plurality of second individual channels include, respectively:

a plurality of second pressure chambers overlapping with the plurality of second nozzles, respectively, in the third direction; and a plurality of second descenders extending in the third direction and connecting the plurality of second nozzles to the plurality of second pressure chambers, respectively, wherein the plurality of first individual connecting channels include, respectively:

a plurality of channels connected to the plurality of first descenders, respectively; and a plurality of channels connected to the plurality of first pressure chambers, respectively, and wherein the plurality of second individual connecting channels include, respectively:

a plurality of channels connected to the plurality of second descenders, respectively; and a plurality of channels connected to the plurality of second pressure chambers, respectively.

9. The liquid discharge head according to claim 1, wherein the first common channel is a channel via which a liquid is allowed to flow into the plurality of first individual channels, wherein the second common channel is a channel to which a liquid is allowed to flow from the plurality of second individual channels, wherein the plurality of second individual connecting channels are opened in an inner wall surface on a side in the second direction of the common connecting channel, and wherein a plurality of parts, of the inner wall surface of the common connecting channel, located between two second individual connecting channels which are included in the plurality of second individual connecting channels and which are adjacent to each other in the first direction, are inclined with respect to the first direction so that each of the plurality of parts approaches in the second direction further toward outside of the common connecting channel, as each of the parts approaches more closely in the first direction to the two second individual connecting channels.

10. The liquid discharge head according to claim 1, wherein the first common channel is a channel via which a liquid is allowed to flow into the plurality of first individual channels, wherein the second common channel is a channel to which a liquid is allowed to flow from the plurality of second individual channels, wherein the plurality of second individual connecting channels are opened in an inner wall surface on a side of the second direction of the common connecting channel, and wherein a plurality of parts, of the inner wall surface of the common connecting channel, located between two second individual connecting channels which are included in the plurality of second individual connecting channels and which are adjacent to each other in the first direction, are curved so that each of the plurality of parts projects toward an inner side in the second direction of the common connecting channel.

11. The liquid discharge head according to claim 1, wherein the common connecting channel is a channel which extends continuously in the first direction along the plurality of first individual channels and the plurality of second individual channels.

12. The liquid discharge head according to claim 11, wherein a length in the second direction of the common connecting channel is longer than a length in the first direction of each of the first individual connecting channels and a length in the first direction of each of the second individual connecting channels.

13. The liquid discharge head according to claim 11, wherein a length in the second direction of the common connecting channel is longer than a length in the second direction of each of the first individual connecting channels and a length in the second direction of each of the second individual connecting channels.

14. The liquid discharge head according to claim 11, wherein the first individual channel row and the second individual channel row are arranged side by side in the second direction at an interval therebetween, and wherein the common connecting channel is arranged, in the second direction, between the first and second individual channel rows.

15. The liquid discharge head according to claim 11, wherein the first individual channel row and the second individual channel row are arranged side by side in the first direction to thereby form an individual channel row, and wherein the common connecting channel extends continuously in the first direction along the first individual channel row and the second individual channel row.

16. The liquid discharge head according to claim 15, wherein in the common connecting channel, channel resistance per unit length of a part, of the common connecting channel, which is located in the first direction between the first individual channel row and the second individual channel row is greater than channel resistance per the unit length of a part, of the common connecting channel, including a connecting part with respect to the plurality of first individual channels constructing the first individual channel row, and is greater than channel resistance per the unit length of a part, of the common connecting channel, including a connecting part with respect to the plurality of second individual channels constructing the second individual channel row.

17. The liquid discharge head according to claim 15, wherein in the common connecting channel:

channel resistance per unit length of a part, of the common connecting channel, which includes a connecting part with respect to the plurality of first individual channels constructing the first individual channel row becomes greater as approaching more closely, in the first direction, to the second individual channel row, and channel resistance per unit length of a part, of the common connecting channel, which includes a connecting part with respect to the plurality of second individual channels constructing the second individual channel row becomes greater as approaching more closely, in the first direction, to the first individual channel row.

18. The liquid discharge head according to claim 16, wherein channel resistance of the plurality of first individual connecting channels and channel resistance of the plurality of second individual connecting channels are all same.

19. The liquid discharge head according to claim 15, wherein in the plurality of first individual connecting channels, channel resistance of a certain first individual connecting channel, among the plurality of first individual connecting channels, becomes greater as the certain first individual connecting channel is located in the first direction more closely to the second individual channel row, and wherein in the plurality of second individual connecting channels, channel resistance of a certain second individual connecting channel, among the plurality of second individual connecting channels, becomes greater as the certain second individual connecting channel is located in the first direction more closely to the first individual channel row.

20. The liquid discharge head according to claim 19, wherein the common connecting channel has channel resistance per unit length which is uniform over an entire length in the first direction of the common connecting channel.

21. The liquid discharge head according to claim 15, wherein the individual channel row is provided as a plurality of individual channel rows which are arranged side by side in the second direction, wherein in each of the plurality of individual channel rows, a distance in the first direction between a first nozzle included in the plurality of first nozzles and provided on a first individual channel which is included in the plurality of first individual channels and which is located most closely to the second individual channel row, and a second nozzle included in the plurality of second nozzles and provided on a second individual channel which is included in the plurality of second individual channels and which is located most closely to the first individual channel row is greater than a distance in the first direction between first nozzles included in the plurality of first nozzles and provided on two first individual channels which are included in the plurality of first individual channels and which are adjacent to each other in the first direction and a distance in the first direction between second nozzles included in the plurality of second nozzles and provided on two second individual channels which are included in the plurality of second individual channels and which are adjacent to each other in the first direction, and wherein positions in the first direction of areas, in the plurality of individual channel rows, respectively, each of which is between the first and second individual channel rows, are different among the plurality of individual channel rows.

22. The liquid discharge head according to claim 15, further comprising a connecting channel which is located between the first common channel and the second common channel in the first direction, which extends in the first direction so as to connect the first common channel and the second common channel to each other, and wherein the connecting channel has channel resistance per unit length which is greater than channel resistance per unit length of each of the first and second common channels.

* * * * *